US011325185B2

(12) United States Patent
Nagel et al.

(10) Patent No.: US 11,325,185 B2
(45) Date of Patent: May 10, 2022

(54) SEQUENTIAL PROCESSING OF MATERIALS AND COATINGS OF VARIABLE AND CONTROLLABLE DENSITY WITH NANOMETER AND MICROMETER SUB-STRUCTURES

(71) Applicant: The George Washington University, Washington, DC (US)

(72) Inventors: David Joseph Nagel, Falls Church, VA (US); M. Ashraf Imam, Great Falls, VA (US)

(73) Assignee: The George Washington University, Washington, DC (US)

( * ) Notice: Subject to any disclaimer, the term of this patent is extended or adjusted under 35 U.S.C. 154(b) by 0 days.

(21) Appl. No.: 16/673,419

(22) Filed: Nov. 4, 2019

(65) Prior Publication Data

US 2020/0139438 A1 May 7, 2020

Related U.S. Application Data

(60) Provisional application No. 62/755,158, filed on Nov. 2, 2018.

(51) Int. Cl.
*B22F 7/00* (2006.01)
*B22F 1/054* (2022.01)
(Continued)

(52) U.S. Cl.
CPC ..... *B22F 3/14* (2013.01); *B22F 1/054* (2022.01); *B22F 3/16* (2013.01); *B22F 7/002* (2013.01);
(Continued)

(58) Field of Classification Search
CPC ..... B22F 3/14; B22F 1/0018; B22F 7/002; B22F 1/025; B22F 2202/06; B22F 2202/05; B22F 2202/07
See application file for complete search history.

(56) References Cited

U.S. PATENT DOCUMENTS

2005/0074600 A1* 4/2005 Ma ..... H01F 41/0246 428/328
2017/0021417 A1* 1/2017 Martin ..... B33Y 10/00

OTHER PUBLICATIONS

Yadoji et al., Microwave sintering of Ni—Zn ferrites: comparison with conventional sintering, Materials Science and Engineering B98 (2003) pp. 269-278 (Year: 2003).*

(Continued)

*Primary Examiner* — Rebecca Janssen
(74) *Attorney, Agent, or Firm* — Blank Rome LLP

(57) ABSTRACT

A multi-step method to produce materials, and coatings of materials, which has three key characteristics. The first is that the density of the resulting materials or coatings can be controllably and widely variable from less than ten percent of normal density up to normal density. The second key characteristic of the invention is the use of starting materials having powders that have grains (particles) with one, two or three dimensions on the size scales of nanometers or micrometers. The third major characteristic part of the invention is the use of microwave radiation or induction heating to quickly raise the temperature of the powders to produce materials or coatings before deleterious diffusion and densification can occur. These features produce new types of materials with properties favorable to many applications, such as chemical and other catalysis, electrolysis in batteries and fuel cells, and light weight structural components.

16 Claims, 5 Drawing Sheets

(51) Int. Cl.
*B22F 3/16* (2006.01)
*B22F 3/14* (2006.01)
*B22F 1/17* (2022.01)

(52) U.S. Cl.
CPC ..... *B22F 1/17* (2022.01); *B22F 2202/05* (2013.01); *B22F 2202/06* (2013.01); *B22F 2202/07* (2013.01)

(56) References Cited

OTHER PUBLICATIONS

Al-Qureshi et al., Analyses of the fundamental parameters of cold die compaction of powder metallurgy, journal of materials processing technology 199 (2008) 417-424 (Year: 2008).*
Ahmed et al. Correlation between factors controlling preparation of porous copper via sintering technique using experimental design, Powder Technology 175 (2007) 48-54 (Year: 2007).*
Agrawal et al., Microwave Sintering of Ceramics, Composites and Metallic Materials, and Melting of Glasses, Transactions of the Indian Ceramic Society 65 (2006) 129-144 (Year: 2006).*
J. Rojek, et al., "Modeling of a Sintering Process at Various Scales", XXI International Polish-Slovak Conference Machine Modeling and Simulations 2016, Procedia Engineering, vol. 177, 2017, pp. 263-270.
S. Raynova, et al., "Effect of Microwave Sintering Parameters on the Physical and Mechanical Properties of Pure Ti and Blended Elemental Ti Alloys", Key Engineering Materials, vol. 770, 2017, pp. 52-59.
W. Liu, et al., "Recent Progress in Rapid Sintering of Nanosilver for Electronics Applications", Micromachines, www.mdpi.com/journal/micromachines, 2018, vol. 9, No. 346, pp. 1-17.
J. Liu, et al., "Sintering-Resistant Nanoparticles in Wide-Mouthed Compartments for Sustained Catalytic Performance", Scientific Revorts. www.nature.com/scientificreports, 2017, pp. 1-8.
A. Kocjan, et al., "The Agglomeration, Coalescence and Sliding of Nanoparticles, Leading to the Rapid Sintering of Zirconia Nanoceramics", Scientific Reports, www.nature.com/scientificreports, 2017, pp. 1-8.
M. A. Imam, et al., "Consoliation of Cristal Metals Powder orf Titanium and its Alloys by Microwave Energy to Near-Net Shape", 2015, 6 pgs.
V. Duz, et al., "Pressing and Sintering of Titanium Powders", ASM Handbook, vol. 7, Powder Metallurgy, asminternational.org, 2015, 10 pgs.
J. E. Burke, "Microscopic Study of Distribution of Pores", Sintering Key Papers, 1990, 2 pgs.
B. Buesser, et al., "Sintering Rate and Mechanism of $TiO_2$ Nanoparticles by Molecular Dynamics", J Phys Chem C Nanometer Interfaces, 2011, vol. 115, No. 22, 15 pgs.

* cited by examiner

SEQUENTIAL PROCESSING OF MATERIALS AND COATINGS OF VARIABLE AND CONTROLLABLE DENSITY WITH NANOMETER AND MICROMETER SUB-STRUCTURES

RELATED APPLICATIONS

This application claims the benefit of U.S. Provisional Application No. 62/755,158, filed Nov. 2, 2018, the entire contents of which are incorporated herein by reference.

BACKGROUND OF THE INVENTION

Field of the Invention

The present invention relates to a method for rapid processing of materials and coatings of variable and controllable density with nanometer and micrometer sub-structures.

Background of the Related Art

The utility and applications of materials depend on their properties, that is, how they perform during use. The properties of materials depend on their composition and structure, that is, what elements or compounds are present, and their arrangement in space on all levels from the atomic to the macroscopic. The composition and structure of materials are determined by how they are processed, that is, by how the elements or compounds are brought together, and then treated by thermal, mechanical, chemical or other means. Hence, it is necessary to employ carefully chosen and executed methods for processing of materials to achieve the composition and structure combinations that will have the properties needed for desired applications.

The diversity of Materials Science and Technology, and the engineering and practical use of materials, are great for several reasons. First, there are many types of materials. The major groups include metals and alloys, elemental and compound semiconductors, ceramics and other compounds, and polymers and organic materials. Second, the starting feedstocks for the production of any specific material can vary widely. The feedstocks include powders of any of the major types of materials with particle sizes on the scale of nanometers or micrometers in one or more dimensions. Third, the number, sequence and execution of the steps that might be used to process the feedstock into the final material are very large. For example, the choice of processing temperatures for various steps is usually critical. Because of these considerations, the production of materials with the desired properties for an application or range of applications is generally complex and far from obvious.

Processes to produce materials generally result in products that are mostly or entirely free of internal voids. Hence, they are fully dense. Their internal and external compositions and structures of such bulk solids can be manipulated by a wide variety of methods, such as heat treating and deformation. But it is rare to be able to introduce voids into bulk materials to achieve desired properties. There are also numerous processes that can result in materials that do contain voids, also called pores, so that they have less than full density. However, in most cases, the shapes and size scales of the internal pores are not well controlled to determine the properties and applications of the materials.

Further, the average composition, and spatial variation of the composition, are generally not well controlled within porous materials.

An alternative strategy to achieve porous materials in which both the composition and structure are controllable is to start with powders of the elements or compounds that are desired in the final product. Powder metallurgy is an old field, in which choices of the composition, and the shape and sizes of particles, and what materials are mixed, compacted and heated, can result in materials with diverse properties and applications. The heating leads to diffusion of atoms between the particles, a process called sintering. In most cases, the compaction and sintering are done to achieve bulk materials that are nearly fully dense. Such an approach destroys many desirable chemical, optical or other properties that the starting particles possess. It is desirable to have processes that will variably and controllably produce macroscopic porous materials with internal structure on the scale of nanometers or micrometers, wherein the properties of the fine scale structures are preserved.

The results from the use of this invention include both bulk materials and coatings. For the purposes of this invention, the term bulk does not mean large volumes of materials. Rather, it defines materials which have all three directions or dimensions (which might be called length, width and height) with thicknesses of 1 mm to 500 mm. Pieces of bulk materials do not require external support to maintain their external shapes. By contrast, coatings are thin layers of one material on another supporting or substrate material, with thickness (narrowest dimension) is not limited to, but is commonly about 0.1-10 mm.

SUMMARY OF THE INVENTION

A method and system are provided to produce materials, and coatings of materials, which have three key characteristics. The first is that the density of the resulting materials or coatings can be controllably and widely variable from less than ten percent of normal density up to normal density. The second key characteristic of the invention is the use of starting materials having powders that have grains (particles) with one, two or three dimensions on the size scales of nanometers or micrometers. The third major feature of the invention is the use of microwave radiation or induction heating to quickly raise the temperature of the powders to produce materials or coatings before deleterious diffusion and densification can occur.

These and other objects of the invention, as well as many of the intended advantages thereof, will become more readily apparent when reference is made to the following description, taken in conjunction with the accompanying drawings.

DETAILED DESCRIPTION OF THE INVENTION

Figure 1:
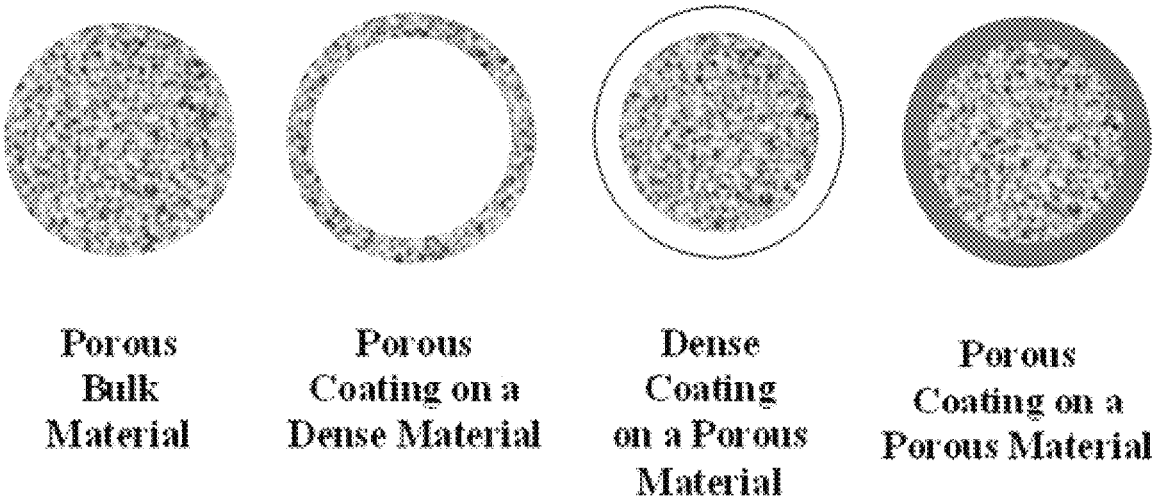
FIG. 1 shows the various materials provided in accordance with the invention.

In describing the illustrative, non-limiting embodiments of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several embodiments of the invention are described for illustrative purposes, it being understood that the invention may be embodied in other forms not specifically shown in the drawings or described in the text.

This invention describes an innovative sequence of process steps to achieve materials and coatings of materials with diverse composition, which have variable and controllable density. The range of densities can vary from as little as 10% to 100% of full density. That is, both the average and local densities can vary (i.e., the density within the material can vary, or the density can be uniform but any desired variable density) within the range from 10 to 100% of being fully dense, with no pores inside of the materials. The particles and pores in the materials and coatings have spatial structures on the scale of nanometers, micrometers or larger, with spatial scales of nanometers or micrometers being preferred. The nanometer scale includes material structures with at least one, and possibly two or three dimensions measured in nanometers, that is, within the range from less than 0.1 to greater than 100 nanometers, where 0.1-100 nm is preferred, but can be less than 0.1 nm and more than 100 nm. The micrometer scale includes structures of materials with at least one, and possibly two or three dimensions measured in micrometers, that is, within the range from less than 0.1 to greater than 100 micrometers, where 0.1-100 micrometers is preferred, but can be less than 0.1 micrometers and more than 100 micrometers. The material has to have some density to exist, and the range of density depends on the function or functions the material has to provide.

The invention is especially useful with these small particles (such as powders) because they have desirable properties that are not found on larger particles (or are found in lesser degree), such as atoms being on the surface, no bonding on the sides, and differing electronic structure. However, those small particles are difficult to handle, for example they can get swept away by reactants. Thus, the invention processes those small particles to avoid loss of those properties (e.g., by fast sintering) to provide bulk materials or coatings with the fine-scale structures of small particles.

A key feature of the processing sequence is the use of microwave or induction heating to rapidly sinter a loose powder within a mold or other container into an integrated piece of porous material before diffusion destroys the nanometer or micrometer scale particles. The invention relies on relatively low temperature sintering, (often <0.5 of the melting point of the powders) for relatively short times (<30 minutes) to achieve inter-particle bonding without excessive and destructive diffusion. This achieves bonding and avoids destructive diffusion, for example by controlling the amount of diffusion (atomic motion due to thermal vibrations) during sintering. There has to be enough diffusion to produce inter-particle bonding, but not so much as to eradicate the fine scale particles by grain growth and, hence, loose their desirable properties due to their small sizes. Being able to make integrated pieces of material or coatings that have the fine-scale sub-structures is a key feature of this invention. The external shape of the resulting materials is unconstrained, and includes planar, cylindrical, spherical or any arbitrary shapes. The size of the produced materials is similarly unconstrained, ranging from less than one millimeter in maximum dimension to as much as one meter or larger, depending on the size of the processing facility.

There are two relevant time scales, the time it takes to start to heat the work piece and the time it takes for the workpiece to achieve the desired temperature for sintering. A conventional furnace has thermal inertia due to the masses of its side walls, top and bottom. Hence, it takes time to heat the furnace itself. The walls and other surfaces of the furnace have to become hot, and then heat the contents of the furnace. Some heat is transferred to the work piece quickly by radiation, but most of the heat from the conventional furnace is transferred by first heating the atmosphere and then the workpiece. It takes ten minutes or longer for heat to be coupled from a conventional furnace into a workpiece, the first time. Then, it takes a comparable time for the heat available at the outside of the workpiece to soak through it to achieve the desired sintering temperature, the second time. That is, sintering with a conventional furnace requires ten to 30 minutes to achieve the desired temperature conditions within the work piece.

Microwave and induction heating are each very rapid ways of heating the material. For each of those, heat is available at the surface and much of the interior of a workpiece as soon as the microwave generator or induction is energized. Hence, both of the relevant times are much shorter. They are commonly on the scale of a 1 second to ten minutes, depending on the characteristics of the workpiece and the magnitude of the powers provided by the microwave generator or induction unit.

This invention primarily deals with the processing of nano- or micro-meter sized particles, available from any process or source, into or onto structures with properties that make them useful as catalysts, electrodes or other structures in many systems. The presence of such fine-scale structures of many kinds within or on the surfaces of solid materials (substrates) affects the properties and, hence, the utility of such structures. Th applications discussed here are merely exemplary. Thus, applications not explicitly cited in this disclosure are not excluded, that is, all uses of materials made by the disclosed processes are included. The production of variable density structures or coatings is one of the main features of this invention.

The invention describes materials and coatings made by the sequence of processes. Cross sections of materials made by the disclosed processes are shown in FIG. 1. Circular cross sections of cylindrical pieces of material are shown for illustration. However, the invention embraces any geometry for the final bulk materials or coatings. As indicated in FIG. 1, it is possible to form bulk materials with sub-structures on the scale of nanometers and micrometers.

The left diagram in FIG. 1 shows a case where the entire bulk of the structure having nano- or micro-meter sized particles has been prepared with processes disclosed herein. It is also possible to produce coatings of such materials on dense starting materials obtained and prepared by any means. The second diagram from the left in FIG. 1 shows the case where a structure procured or prepared by means not disclosed here, is coated with a layer of nano- or micrometer sized particles. The inverse geometry is also possible. The third diagram from the left in FIG. 1 shows a bulk material made by the means of this invention is coated with a dense material produced by conventional electrochemical, evaporation, sputtering or other known means. The coating of one under-dense porous substrate material with another porous material is also possible, where the coating can have the same composition but different structures as the substrate, or can different in both composition and structure. The right diagram in FIG. 1 shows the cross section in which both the interior and the coating of the structure have been prepared in sequential steps using the disclosed methods. That diagram is meant to indicate that different nano- or micro-meter sized particles can be used within and on the produced structures.

Figure 2:
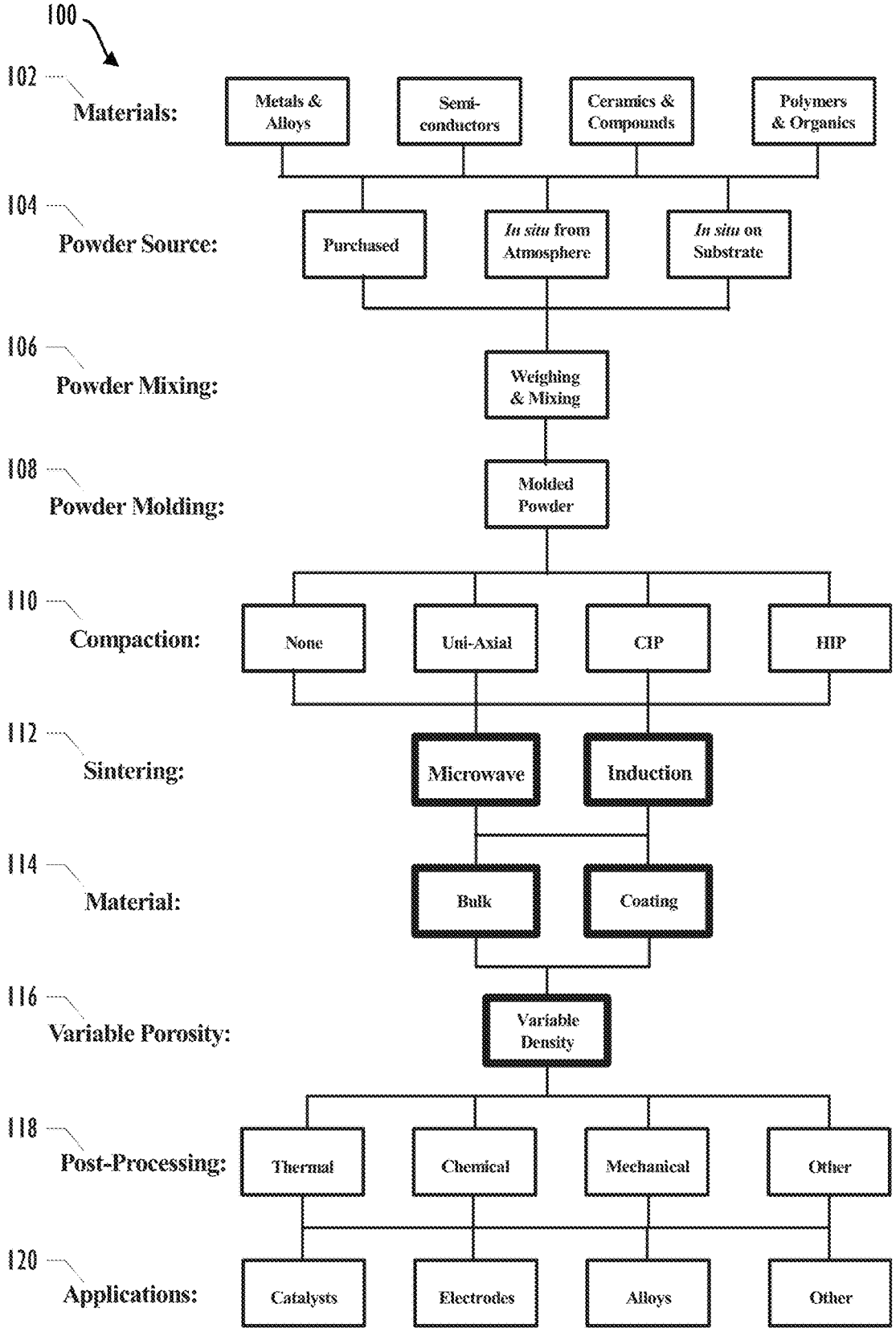
FIG. 2 shows the process in accordance with the invention.

FIG. 2 shows the sequence of process steps 100 in this invention, along the left side. That sequence includes selection of materials 102, selection of powder source 104, powder weighing and mixing 106, powder molding 108, compaction 110, sintering 112, produced material 114, variable porosity 116, post-processing 118, and applications 120.

Production of Bulk Materials

Materials 102

Figure 3:
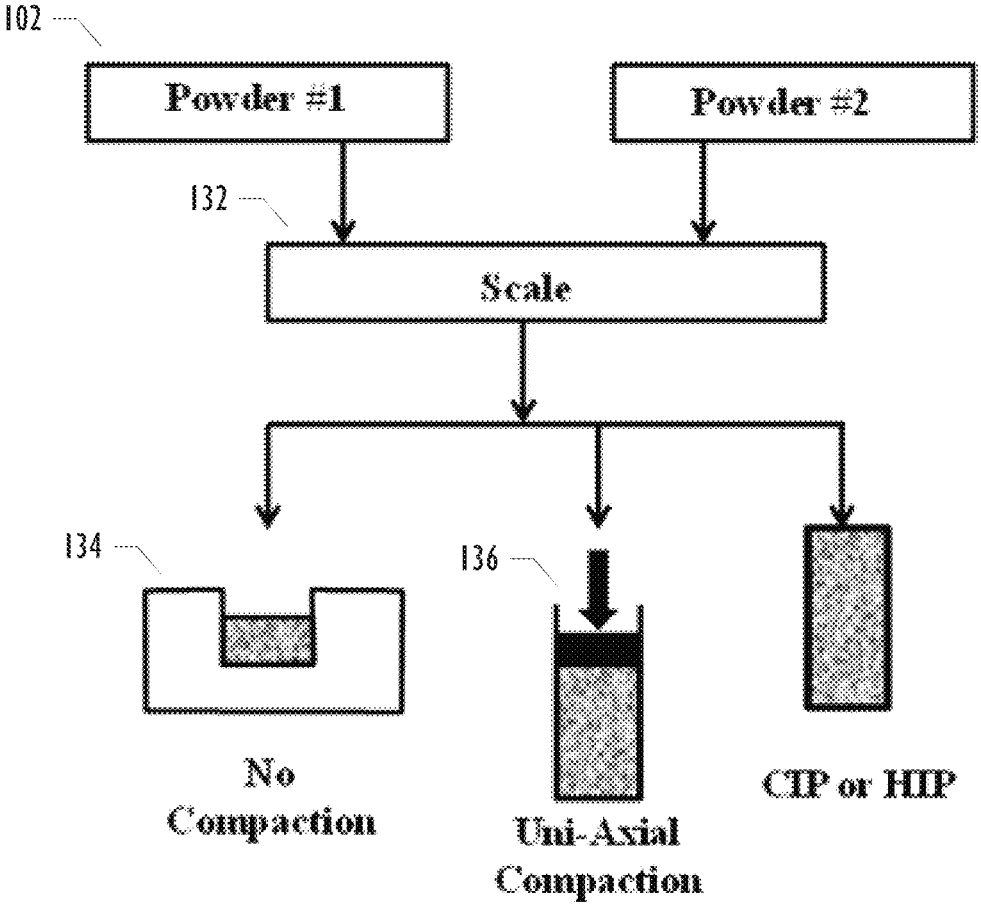
FIG. 3 is a block diagram of the weighing, molding and compaction of powder in accordance with the invention.

Referring to FIG. 2, the starting point is the selection of materials 102 from one of the four major classes of materials. They include (a) metals and alloys, (b) elemental or compound semiconductors, (c) inorganic glasses, ceramics, compounds and (d) polymers and other organic materials. Which classes of material is chosen, and which material(s) from those classes depends on the material that is desired at the end of processing, and its associated properties and applications. All options are possible during use of this disclosed process. FIG. 3 also shows the selection of a powder material 102.

The shapes and compositions of the nano- and micrometer particles vary widely. Their sizes are such that at least one dimension of the structure falls within the nanometer or micrometer scale as defined above. The particle shapes can include clusters of atoms or molecules, or other particles that are equiaxed, that is, nearly the same length scale in all three dimensions. The nanostructures might have dimensions on the nanometer or micrometer scales in only two dimensions. In that case, they are small in cross section (the two dimensions), but long in the remaining dimension. These are essentially linear in shape. The particles of interest here can have dimensions on the nanometer or micrometer scales in only one dimension, essentially the thickness of a thin sheet that might have lengths in the other two dimensions that can even exceed millimeters. These particles can be of uniform or varying thickness and be flat or curved in any manner.

The use of powders in which the particles contain metals or alloys, either alone or with ceramics or other compounds is a preferred embodiment for the production of bulk materials. The use of powders with particles of metals or alloys, either alone or with ceramics or other compounds on the surface of substrates, is a preferred embodiment for the coating of said substrates.

Most of the individual processing steps that can be used in the disclosed sequence of processes in accordance with suitable conventional operations, although some are improved for use with the invention. Whether or not any of the steps includes our innovations, we describe the character of all of the individual processing steps, the sequence and results of which constitute this invention.

The invention includes the sub-structure of a material, i.e., the spatial variations in the identity and arrangement of atoms within the material, such as having particles of different compositions, shapes and sizes next to each other. Materials made according to the invention can have diverse sub-structures, given the wide range of compositions, particle sizes and porosities (densities) that can be achieved with the invention. The materials have compositions (what atoms are put into them, both on average and with local spatial variations), and structure (the way in which the atoms are arranged in space, both on average and with local spatial variations). The sub-structure refers to the local spatial variations in the composition and structure of the material.

Powder Sources 104

The second step in the overall process 100 of FIG. 2 is to obtain powder(s) of specific materials 102 from the applicable classes of materials. This can be done in different ways. One method is to prepare or purchase one or more powders with the desired composition, shape and size. Preparation can be done by grinding or other means of reducing larger structures to fine-scale particles or else growing them in any fashion. They can be used as-produced or modified by any process prior to employment in this invention. The use of separately produced or procured fine-scale particles will be the most common embodiment of this invention for production of bulk porous materials. Some examples of independently-manufactured nanostructures that might be employed include nano-particles, clusters of atoms or molecules, large molecules such as bucky balls, carbon nanotubes, and pieces of thin materials with nanometer-scale thickness, such as graphene and other layers of covalently-bonded materials, with any of these bare or coated with any materials in any geometry.

Another method is to produce one or more of the starting powders. Nano-scale and micro-scale materials can be produced in two major ways. One is to take bulk materials and process them in such a manner, for example by ball milling of brittle materials, to obtain fine-scale powders. This is called the top-down approach. The other major approach to production of nano-scale and micro-scale materials is to grow them from precursor chemicals in containers of liquids or gases at any pressures, or else within a vacuum chamber into which reactants are introduced.

The materials that form the particles within or on a surface can come either from the substrate or from some other source. The particles can be formed of materials that do not originate in the substrate. In this case, the particles can either be grown by physical vapor deposition onto the substrate from some nearby source of atoms, or by chemical vapor deposition onto the substrate from diverse ambient atmospheres of appropriate compositions, pressures, temperatures and means of excitation. Thus, the source of the atoms in the material particles can originate in the atmosphere within the processing chamber (i.e., in situ from atmosphere), or they can originate in the substrate while it is within the processing chamber (i.e., in situ from substrate. Wires and whiskers with nanometer or micrometer dimensions can be grown on substrates by various deposition technologies. Fixation of particles to substrates is achieved by use of the energy from microwave, inductive or other equipment, if it does not occur as particles produced in situ contact the substrate.

The purchase or other procurement of powders may be better suited for the production of bulk materials. Growth of particles on the surface of substrates may be better suited for the coating of said substrates.

Powder Mixing 106

Regardless of how the starting powdered materials are obtained, the next step in the disclosed process 100 of FIG. 2 is to weigh portions of each material to be used 106, in amounts and ratios that will produce the final desired materials. Widely varying ratios of the starting materials can be used to achieve diverse compositions in the produced material. Referring to FIG. 3, a scale 132 can be utilized to weigh the powders 102. After weighing, the particles can be mixed by any means, including stirring, shaking, vibration, ultrasound, etc. Weighing and mixing of the powders within an inert atmosphere is the preferred embodiment for two reasons, maintenance of the purity of the powders and safety of personnel from exposure to some powders that pose health hazards. The inert atmosphere can be provided, for example, by having the scale inside a sealed housing or processing chamber and pumping out the air (which contains reactive oxygen and nitrogen), and then filling the processing chamber with a gas that does not react, typically argon.

Molding 108

In the next step of the process 100 of FIG. 2, the mixed powders are molded 108. Referring to FIG. 3, in one embodiment, the powder 102 is placed in a mold or container 134 of any shape. The molds 134 can be made of metals or alloys, or ceramics or glasses, with softening or melting points adequately high to withstand the temperatures required for sintering. Refractory materials with high melting points are preferred for molds, so that the powders in the molds do not form strong attachments to the molds during sintering. Ceramic materials, such as alumina and boron carbide or nitride, are possible molds, although other refractory materials can be used as molds.

Containers will be made of metals or alloys. The mold or container can contain only a single powder or a homogeneous mixture of powders. It can also contain layers of either single or mixed powders in any geometry, to produce products that have non-uniform distributions of either or both composition or structure. The use of powders with two or more particle sizes or shapes made of metals and alloys that can be used as layer structures range from small to large particle size, or from one shape to another. This will create a graded structure resulting into variable mechanical and other properties from surface to inside. This can, for example, be used where one needs a hard surface (small particle size resulting into small grains), but higher fracture-toughness surface inside (large particle size resulting into large grain).

The compositions of the nanostructures that are small in three, two or one dimension(s) can include any atoms or molecules, either uniformly distributed (for a single composition) or varying in any manner (for spatially-varying compositions). If the compositions within the mixtures vary spatially, they can do so within any one or more phases. There are no limits on the variations of composition in any directions. Any gradients that can be realized through equilibrium or non-equilibrium means are acceptable for particles used in the disclosed processes. An additional step of vibration or insonification of the loose powders in the molds prior to compaction is also part of this invention.

The use of open ceramic molds with rectangular cavities that are relatively thin in one dimension is a preferred embodiment, in order to produce sheets of porous bulk materials which can be sintered by microwaves or induction in short times.

Compaction 110

The next step in the disclosed process 100 of FIG. 2 can be compaction 110 of the powders in the molds or other containers. Compaction prior to sintering is optional and not a requirement of this invention, for example if a low density (high porosity) material is to result at the end of the process sequence. It is possible to place uncompacted powders in molds that can withstand high temperatures and perform the microwave or induction heating. The material density can vary depending on what function it plays. The invention can produce materials with densities from 10 to 100% of their full density (no pores), where a low density can be less than 75% of full density and high porosity has the total volume of pores in the range from 25 to 90% of the total volume of the material. A high temperature can be, for example, above the melting points of any of the component powders of the materials being produced.

It is commonly desirable to provide compaction of the loose powders by a compaction device, such as those shown in FIG. 3. The first is uni-axial compression by a mechanical or hydraulic piston 136 that fits snuggly into the reservoir 134 containing the powder(s). This removes air from the powder and promotes adhesion between particles. The result is a structure that retains its shape, so it can be inserted into the microwave or induction processing system. Pressures up to many times one atmosphere are used for such compaction, depending on the materials and targeted porosity. The powder(s) placed into the reservoir prior to compaction may contain only elements or compounds that are desired in the final structure. They may also contain finely-divided organic materials that will serve as binders for the structure resulting from compaction. The organic molecules can remain in the final structure, or else be removed by high temperature pyrolysis before, during or after the microwave or induction processing. Compaction can range from no increase in the density of the mixture of powders (that is, no compaction) to almost full density, if very high pressures are used during compaction. What matters is not the degree of compaction but, rather, the density of the material without or with compaction, prior to sintering. That is, the degree of compaction depends on the maximum pressure used for the compaction. The relationship between the degree of compaction and the pressure varies with the composition and other characteristics of the powder mixture.

The second means of compression involves placing the powders into thin-walled and sealed containers of a metal or alloy. The container is then put into a chamber in which a gas or liquid can be pressurized up to many times one atmosphere for such compaction, depending on the materials and targeted porosity. The pressures can be held for times up to 30 minutes. The high pressure deforms the powder container and compacts the powder(s) within it. If the pressurization and compaction is done at ordinary temperatures, the process is called Cold Isostatic Pressing (CIP). If done at elevated temperatures, the compaction process is called Hot Isostatic Processing (HIP). Temperatures as high as 2000 C can be used.

Most bulk materials produced using this invention will be made with either no compaction, or else a relatively slight uniaxial compaction, so these methods are preferred embodiments.

Sintering with Microwaves 112

Whether or not, and how, a mixture of powders is compacted, the next stage in the process 100 of FIG. 2 is heating 112, for example, using a heating process called sintering. Heating 112 promotes bonding between particles by diffusion. Heating can also lead to removal of any binders that have been employed. That process is called pyrolysis. Both sintering and pyrolysis can be done at a wide variety of temperatures and pressures for diverse times to achieve the desired structures and properties. Again, low temperature can be <0.75 (or <0.5) melting point and short times can be (<30 minutes). Accordingly, the invention bonds the particles with in the mixture of powders such that a single piece of material results without overdoing that bonding, which will lead to particle growth, loss of control over the porosity and loss of the desirable properties of the fine-scale particles. Diffusion (atomic migration stimulated by temperature) produces the desired bonding during sintering, but too much diffusion due to having too high a temperature or heating for too long will lead to destruction of the desirable properties of the particles. The amount of diffusion needed to produce adequate particle-to-particle binding varies with different materials and particles shapes and sizes.

Figure 4:
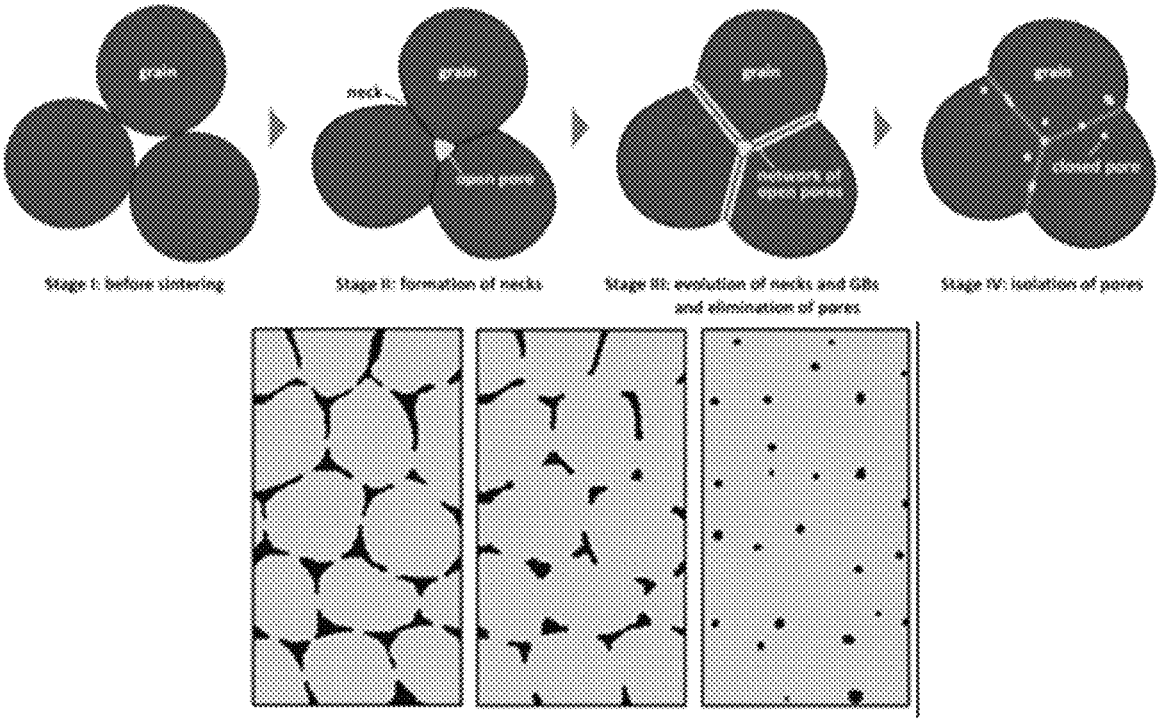
FIG. 4 illustrates the sintering process.

Sintering will be most commonly used in this invention. FIG. 4 shows the stages of sintering, and images of materials sintered for different times. Stage I is pre-sintering, with the particles touching one another at discrete points and having relatively large open pores between the particles. At stage II heating begins and the particles begin to move inward toward each other, forming a neck between the particles with larger surface area touching each other, and a reduction in the open pore in the middle of the particles. At stage III heating continues and the particles continue to move inward toward each other. The necks increase and become more linear, and the open pore decreases in size, essentially forming a network of pores. At stage IV heating continues and the particles continue to move inward. The pores are essentially eliminated between the particles, though isolated pores may be found. The particle motion is due to diffusion of atoms. The amount and application of heating varies with the materials and their melting points. Heating is generally confined to temperatures lower than 0.95 of the melting point of the lowest melting point powder being processes, with temperatures measured on the centigrade scale.

Accordingly, FIG. 4 shows that diffusion between particles leads to the shrinking of voids between particles, and densification of the materials during heating. See Sintering in the Powder Metallurgy Process, Powder Metallurgy Review, www.pm-review.com, citing EPMA. Hence, the temperature and time of sintering are major control parameters for achieving the desired structure and properties of materials.

Heating can be done using a heater, such as furnace, microwave device, or microwave device with susceptor. Historically, and still today, sintering of materials is usually done in a high-temperature furnace, commonly in a controlled atmosphere. That approach is both slow and power consumptive. The volume of the furnace has to be heated in addition to the workpiece. Furnace heating is shown schematically on the left side of FIG. 5. The material being processed is indicated by the black rectangles.

Figure 5:
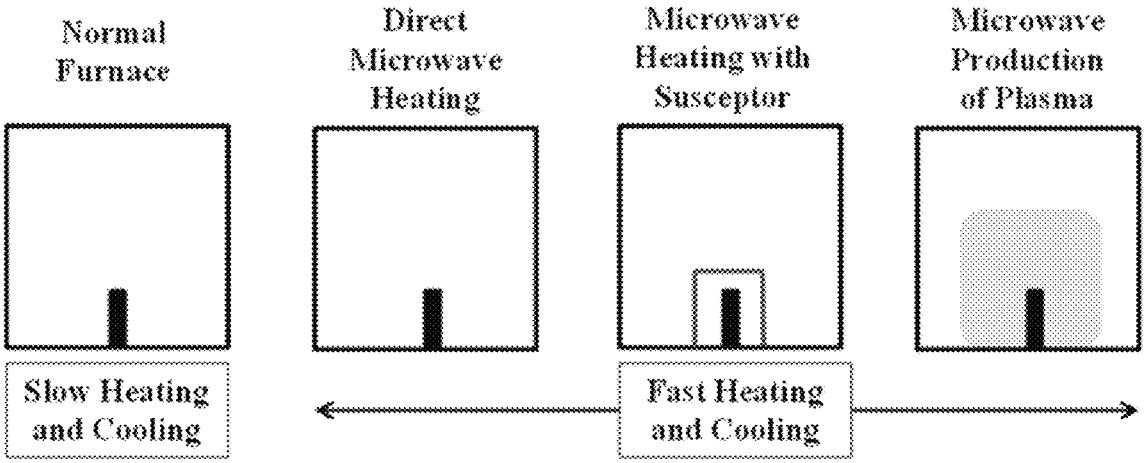
FIG. 5 compares various forms of heating in accordance with the invention.

As further shown in FIG. 5, by contrast to furnace heating, the use of microwaves or induction to heat molded powders to sinter them turns on quickly and can heat mainly the workpiece. The material can be heated in seconds to minutes. This allows the material only limited time for grain growth. Such rapid heating is the characteristic of heating by microwave energy. Induction also play similar role but less effectively. Ideally, the temperature would jump within a second or less from room temperature to the sintering temperature at the start, and then return to room temperature similarly quickly at the end of sintering. If that were possible, one would have precise control over the time that diffusion occurs, and hence, control over the desired degree of bonding to make a single piece of final material without any additional unwanted diffusion, which destroys the properties of the fine scale particles. Microwave and induction heating both offer fast temperature rises (from one second to ten minutes, or from 0.1-30 minutes). When the processing is finished, the cool down times are also less, since the entire furnace does not have to cool in most cases.

The microwave or inductive energy can be coupled directly into the metal of the workpiece, as shown in the second diagram from the left in FIG. 5. Some materials do not readily absorb microwaves. In such cases, a susceptor made of a material that does absorb microwave energy is used around the workpiece, as shown in the center of FIG. 5. More material than the workpiece is heated, but the response times and heated volumes are still substantially less than if an entire furnace is heated.

The microwave chamber is commonly evacuated or filled with an inert gas for either direct coupling or indirect (susceptor) coupling of microwave energy to the workpiece. However, it is also possible to fill the chamber with a gas that will break down electrically to form a plasma due to the microwave irradiation. The particles (ions) from plasmas interact with the surface of a workpiece, as shown schematically in FIG. 5. Those interactions can modify the surface of the workpiece to produce surface features with sizes on the scales of nanometers and micrometers. Such structures can make the material of the workpiece more effective in various applications for the production or catalysis of reactions of any type. It is noted that plasmas can be produced by diverse electrical and optical means, in addition to their generation and sustainability using microwaves. The microwave and gas plumbing to the processing chamber are not shown in the diagrams in FIG. 5.

The times for microwave heating are unconstrained in this invention. They can range from less than one minute, in some cases, to over one hour, in extreme cases, or from 0.1-30 minutes. The ability for such rapid processing of materials is one of the key features of this invention. Most bulk materials and coatings produced by this invention will be amenable to direct microwave heating or can be made with use of a susceptor, so these are the preferred embodiments. The combination of temperature and time of microwave sintering is central to production of materials that are units for insertion into processing chambers or other uses while still maintaining the beneficial properties of the fine scale constituent particle. The material being prepared will determine the combination of time and temperature us bond the particles effectively to each other without undesirable in the growth of those particles and the loss of the desirable properties due to their small sizes.

Sintering by Induction 112

Induction heating has similarities and differences compared to microwave heating. The key similarity is the ability to couple energy directly into a work piece or a susceptor around the work piece, without heating up the mass of a furnace. As noted, that reduces energy consumption, permits very fast heating at the start of a process, and enables faster cool down at the end of a process. The most fundamental difference between microwave and induction heating is the way in which energy is supplied to the work piece, or a susceptor surrounding the work piece. With microwave heating, radiation with frequencies in or near the microwave region of the electromagnetic spectrum is generated, is conducted to the chamber containing the work piece and absorbed by the work piece or susceptor. With induction heating, rapidly changing electrical and magnetic fields are produced by a nearby coil, and the response of electrons within the work piece or susceptor to the high frequency fields leads to scattering of the electrons and heating of the absorber. Electromagnetic radiation is not a requirement for induction heating of materials, as it is in microwave processing of materials. Processing of materials with microwaves requires a grounded outer chamber, as does a kitchen microwave oven. Induction processing can be done in the open, similar to kitchen induction stoves. Hence, it is easier to visually observe induction heating. Induction heating is done with frequencies ranging from 1 kHz to 10 MHz (though could be below 1 kHz or above 10 MHz). Temperatures high enough to melt materials are attainable.

Figure 6:
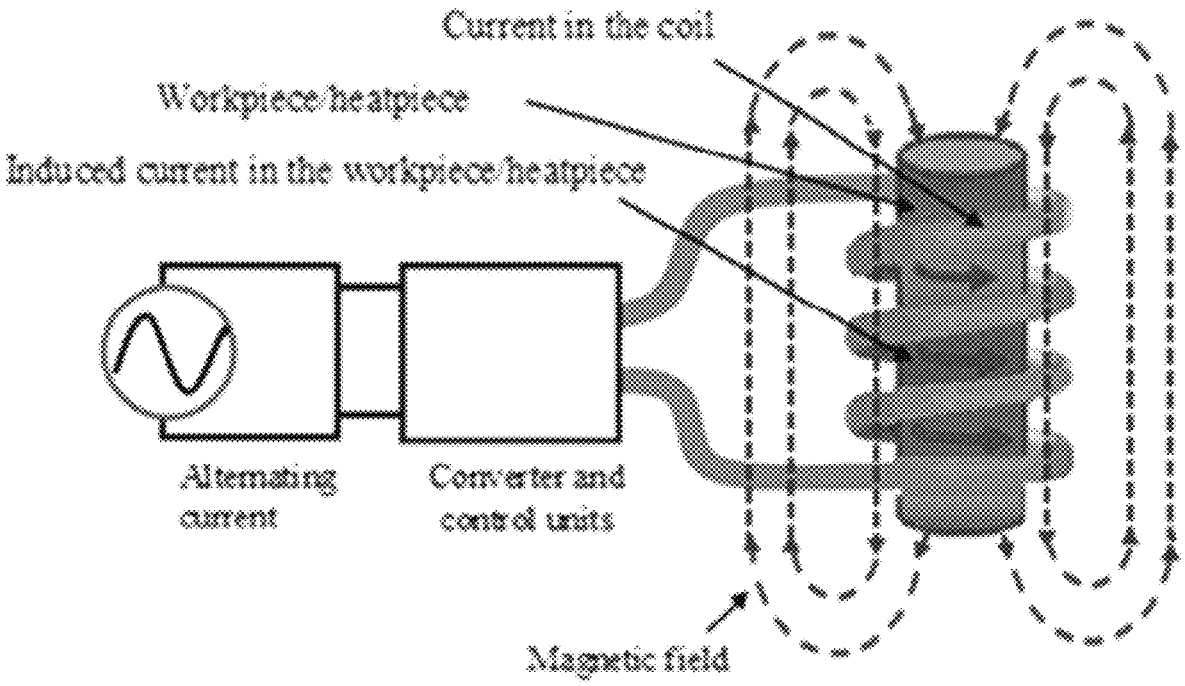
FIG. 6 shows induction sintering.

FIG. 6 shows a circuit that generates the frequencies used for induction heating. See Application of Induction Heating in Food Processing and Cooking, Food Engineering Reviews, June 2017, Vol. 9, Issue 2, pp. 82-90. The circuit includes a coil, workpiece (the heated piece), current source, and converter and control units. The coil is wrapped around the workpiece and connected to the converter. The current source is connected to the converter and controllers, which control the current in the coil to induce a desired magnetic field. The coil is commonly copper tubing through which water circulates to keep the coil from melting. Not shown in that schematic is a chamber or housing, such as for example a glass tube, which can surround the workpiece. The chamber, commonly a tube made out of high temperature glass such as quartz, surrounds the workpiece and is inside the coil. That enables control of the atmosphere around the workpiece without having to bring the coil through the walls of the tube. Use of such a tube enables the work piece, possibly with a surrounding susceptor, to be processed in an inert or other atmosphere or a vacuum. However, some materials and coatings can be processed in air.

The times for induction heating are unconstrained in this invention. They can range from less than one minute, in some cases, to over one hour, in extreme cases, or from 0.1-30 minutes. The ability for such rapid processing of materials is one of the key features of this invention. Most bulk materials and coatings produced by this invention will be amenable to direct induction heating or can be made with use of a susceptor, so these are the most suitable embodiments. The combination of temperature and time of induction sintering is central to production of materials that are units for insertion into processing chambers or other uses while still maintaining the beneficial properties of the fine scale constituent particle. The material being prepared will determine the combination of time and temperature us bond the particles effectively to each other without undesirable in the growth of those particles and the loss of the desirable properties due to their small sizes.

Production of Porous Bulk Materials 114

Turning back to FIG. 2, the process 100 of the invention can be used to produce a desired material 114 having a desired porosity 116, such as for example bulk material and/or coatings.

Post Processing 118

The variable porosity material 116 will commonly have the desired properties for various applications. But, in some cases, it will be necessary to post-process the materials 116 to enhance or instill other desirable properties. Many types of post-processing of the materials 116 are possible. Additional thermal processing, chemical processing, mechanical processing are common possibilities, as indicated in FIG. 2. However, any other means of post processing bulk materials or coatings made by use of this invention are part of the processes of the invention.

Application 120

The processing steps 102-112, and the post-processing 118 that are utilized will depend on the material 114 that is desired to be produced and its desired porosity 116, which can depend on the application 120 for which it will be utilized. For example, one central feature of this invention is the rapid use of microwave or induction heating 112 to produce macroscopic bulk samples of porous materials, which have sub-structures on the scale of nanometers or micrometers, which retain their desirable properties. The resulting bulk materials can have any exterior shape and size. Those features depend on the shape and size of the molds or compacts used, and on the size and features of the microwave or induction facilities that are employed during processing. Commonly used shapes will be rectangular solids and cylinders. The sizes of the produced bulk materials will range from one millimeter to one meter.

The composition of the produced bulk materials can be uniform, or have gradients in any component, depending on how the mold or compact of the starting material is prepared. The fine-scale structure of the produced material can also be uniform or can have gradients in the shapes or sizes of the particles that make it up, again depending on how the compact of the starting material is produced prior to heat treating by microwaves or induction. The bulk materials can be used by itself or coated with other nano- or micro-scale particles, in either case to be employed as catalysts, electrodes or for other purposes. Also, the bulk materials can be coated with dense materials, depending on the application.

Production of Porous Coatings

Three topics are necessary to consider for the production of coatings made of nanometer and micrometer sized particles by use of this invention. The first is the types and characteristics of substrates that can be coated using the methods of this invention. The second is the methods for cleaning or otherwise pre-processing substrates prior to coating. The last is the disclosed means of preparing and fixing the coatings using microwave or inductive heating to produce coatings of variable density with fine-scale substructures for catalysts, electrodes and other purposes.

A. Diverse Substrates are Applicable

If a substrate is to be coated with fine-scale particles, any solid substrate is considered, regardless of its method of production, geometrical shape, size, chemical composition or internal structure. Both homogeneous and inhomogeneous compositions are considered, including multilayered materials. This disclosure embraces diverse substrate forms, from very flat and smooth to substrates that have either or both curvature or roughness to open (under dense) materials, some of which are available commercially. Foamed materials with open cells, which have a large ratio of surface area to volume, are among the preferred embodiments. Exfoliated materials, including both natural and manufactured substances, and materials that are intercalated and subsequently heated, are among the contemplated substrates. Similarly, formed structures, such as the hexagonal shapes common in automotive radiators and other heat exchangers, are also preferred for the same reason for some applications, namely their high surface area to volume ratios.

The lateral extent of the substrates of interest can range in area from less than 1 $mm^2$ to more than 1 $m^2$. The shapes of the more-or-less flat substrates in the lateral dimensions are not constrained. They can vary from essentially linear (narrow and long) shapes to equiaxed shapes, such as squares or circles. For substrates that are volumetric, that is, not essentially thin in one dimension, the largest dimensions can extend from less than 1 mm to over 1 meter. Here also, the shapes of the substrates of interest are not constrained.

Substrates of interest can be prepared and shaped by any means, including but not limited to any one or more of the following processes: rapid decompression, casting, rolling, swaging, machining, abrasion, polishing, sand or other blasting, shot peening, bending, breaking, twisting, punching, trimming by any means and pressing, any or all with or without prior or post heat or chemical treatments. They can also be manufactured by the processes we disclosed for reparation of bulk materials with sub-structures having nanometer and micrometer sized features.

B. Substrate Pre-Processing

Processes are included in the process sequence for this invention, which clean substrates of any geometry, size and materials prior to application of the nanostructures, including but not limited to bathing the substrate in chemicals, with or without mechanical or vibratory actions, or immersion of the substrate in a glow discharge or other plasma of any composition, pressure, temperature and configuration, either process requiring cleaning times ranging from less than one second to over ten hours. Sequential chemical cleaning followed by glow discharge or other plasma cleaning in a glow discharge plasma of an inert gas with purity exceeding 95 atomic percent, each for periods of a few seconds to a few hours (or preferably from one second to one hour), is an included method.

Diverse physical and chemical means can be employed to pre-process existing (as-received or as-produced) substrates to modify them or prepare them to grow nanostructures in place or accept nanostructures for fixation to the substrate. An example of a physical method of pre-processing is mechanical abrasion or polishing. The bombardment of the surface with ions, atoms, molecules, clusters or other projectiles of any chemistry, shape, size, velocity or areal density is another embodiment. Examples of chemical methods for pre-processing substrate surfaces are wet or dry etching using any chemicals or atmospheres. Substrates can be modified by any means, including but not limited to any one or more of the following processes: rolling, swaging, machining, abrasion, polishing, sand or other blasting, or shot peening, any or all such processes with or without prior or post heat or chemical treatments.

The preprocessing steps will, in almost all cases, start with use of any known physical or chemical means of cleaning the substrate surface. Methods to clean or pre-process the substrate process prior to growing nanostructures from the substrate or other material, or to affix pre-existing nanostructures to substrates, are not limited by this invention. They include physical means, such as immersion of the substrates in glow discharge or other plasmas, irradiation of the substrates with quanta (photons, electrons, ions, atoms or molecules) or with clusters or particles, and deposition of any materials in any geometry by any means such as evaporation, sputtering or cluster impact. Also included are chemical processes involving any gaseous or liquid chemicals with reaction rates controlled by time and temperature or any type of electrochemical process. Substrates can be cleaned by any means, including but not limited to any one or more of the following processes: rolling, swaging, machining, abrasion, polishing, sand or other blasting, or shot peening, any or all such processes with or without prior or post heat or chemical treatments.

The processes for modifying or cleaning the substrates that can be used when employing this invention range from static situations in which the substrates do not move relative to the effecting apparatus during processing to those in which the substrates move under control of the processing apparatus by any means. Substrates that are thin in one or two dimension such as sheets of metal or rods of metal, can be moved in any geometry and time sequence in and by the effecting apparatus during processing. For example, plates of material can be rotated during processing by mechanisms in the processing apparatus. Rods of material can be rolled back and forth during processing to insure that their entire curved surface is uniformly treated during a process.

During employment of this invention, any means for moving the ambient gas or liquid surrounding the substrate relative to the substrate can be used. In the case of ambient liquids, pumps, propellers and stirrers within or outside of the apparatus holding the substrates and ambient liquid are among the processes for moving the liquid over and around the substrate, although any other means of inducing such motion is embraced by this invention. One such method is the tilting of the apparatus holding the substrates and the ambient liquid in order to create a sloshing effect. In the case of ambient gases, fans or other moving parts of any kinds within or outside of the apparatus containing the substrates and gases, might be employed In some cases, a thin layer of any desired material will be deposited on the surface of the substrate from any source by any means to control the production of nanostructures from the substrate material or some combination of materials from the substrate and the deposited layer, either with or without chemical reactions. After use to produce nanostructures, the deposited layer will be removed by some chemical or physical means in many cases, but sometimes it will be left in place.

Any of the processes to modify or otherwise prepare the substrate surfaces to grow or accept nanostructures can be carried out without or with the use of catalysts. There are no restrictions on the number and type of catalyst that might be used, or on its method of employment. The catalyst might contain any material(s) with any geometrical shape and size. The catalyst might (a) be produced in place on the substrate by any means, (b) originate from any source and be added to the substrate or nanostructures or (c) involve both of these approaches, either prior to or during any of the processing steps. The catalyst might be left in place after processing or else removed by any means.

C. Coating of Substrates

Earlier-made nano-structures and micro-structures can be brought to and attached to the substrate by diverse processes, some of which are discussed here. Some examples of independently-manufactured nanostructures that might be affixed to a substrate include nano-particles, clusters of atoms or molecules, large molecules such as bucky balls, carbon nanotubes, and pieces of thin materials with nanometer-scale thickness, such as graphene and other layers of covalently-bonded materials, with any of these bare or coated with any materials in any geometry. Methods for bringing together nanostructures from any source and the substrate can involve any means of transport with or without dynamic excitations, such as vibratory, sonic or ultrasonic agitation.

Procedures are included which bring the nanostructures into contact with the substrate by the use of gravity, application of static electric or magnetic fields of any configuration, orientation and strength, or application of tapping or vibratory, sonic or ultrasonic fields of any geometry, direction, frequency or amplitude. Simple packing of the nanostructures onto the substrate in any configuration inside of a container of any materials, geometry, shape and size to contain the nanostructures is another method.

The ambient atmospheres for bringing together pre-made nanostructures and a substrate can vary widely, from high vacuum to gases of any kinds at any temperatures and pressures to liquids in which the nanostructures are suspended. In the last case, the nanostructures can be left to settle on the substrate under the influence of gravity, diffusive or convective forces. The use of applied electric or magnetic fields of any orientation and strength to orient nano- or micro-structures prior to their fixation onto the substrate is part of this disclosure. The fields can also influence motion of the particles onto substrates. Removal of the liquid carrier for the nanostructures by any means is possible, ranging from decantation to evaporation to freezing followed by sublimation or critical point drying. Application of heat, either from an external source or from within the substrate to remove the liquid, is one of the envisioned processes.

Processes that may be used during employment of this invention can provide a bond between the nano- or micro-structures and substrate without any intervening layer by partial melting of the nano- or micro-structures, by partial melting of the substrate or by diffusion of atoms from either or both the nanostructures or substrates onto and into each other to provide a bond by sintering.

Processes are included to provide a bond between the nanostructures and substrate by use of an intermediate layer that serves as an adhesive to meld the nanostructures and the substrate, which layer is of any material and thickness and applied to (coating fully or partially) the substrate prior to application of the nanostructures before the electromagnetic or inductive heating to provide fixation of the nanostructures to the substrate. The bonds between the adhesive layer and the nanostructures, and the adhesive layer and the substrate, can be due to physical adsorption, chemical absorption or diffusional mixing.

The orientations and placements of the nano- or micro-structures on substrates can vary widely. In this case of clusters or particles that are equiaxed, the nanostructures reside on the substrate surface in any orientation. Their maximum height above the substrate surface would be similar to their maximum dimension in any of the three dimensions.

The particles with structures having dimensions on the nanometer- or micrometer-scale in only two dimensions can protrude at any angle from the substrate surface, like nanowires or nano-whiskers. In that case, the thickness of the layer of superficial nanostructures might exceed one millimeter. Or, the long dimension might be parallel to the substrate surface for part or all of its length. If the nanostructure contacts the surface over all of its length, its maximum height above the substrate would be similar to the lateral (cross sectional) dimension of the structure.

Particles with nano- or micro-structures that have dimensions on the finest-scale in only one dimension can be affixed to the substrate in any manner ranging from a very few isolated points of contact, to lines of contact of any width and arrangement to contact over all of the surface of the thin film for the case of flat films lying flat on the substrate. Any orientation of the flat and small nanostructures on the substrate is permitted.

It is noted that the superficial nano- or micro-structures need not only contact the substrate. They can also be in contact with each other, although it is their adherence to the substrate that is the focus of this invention. That is, contact between nano- or micro-structures above the substrate may provide beneficial effects on the ability of the substrate-nanostructure or substrate-microstructure combinations to induce or promote reactions or influence other properties, such as permeability. However, such contacts between nano- or micro-structures grown on or affixed to substrates are not controlled by this invention, even though they are caused to happen during our disclosed processes.

The placement of nano- or micro-structures on the substrates, and hence their areal densities, can be either uncontrolled or controlled in some fashion. The areal density can be defined in at least two different ways. One is the fraction of the substrate surface area that is in contact with nano- or micro-structures of any shape or orientation. This fraction can vary widely from very a small value, say for linear nano- or micro-structures that contact the substrate only at their ends, to unity for contacts everywhere in the case of thin particles that are larger in two dimensions. Another measure of areal density is the fraction of the substrate surface area that is covered by nano- or micro-structures, whatever their shape, size or orientation. Here again, the fraction can be very small, say for widely-dispersed small particles, to over unity, such as overlapping thin films oriented more or less parallel to the substrate surface. Both fractions can also be expressed as cm2 for the contact or coverage per cm2 of the substrate. It is also possible to use the mass of nano- or micro-structures per cm2 of the substrate as the measure of goodness of the processes disclosed here. Whatever the measure of coverage of the substrate by nano- or micro-structures, dense coverage, which will enable or accelerate desired reactions are the preferred embodiments.

Growth of nano- or micro-structures on substrates or addition of pre-existing nano- or micro-structures to a substrate can be unconstrained, that is, uncontrolled. In this case, two variables that can influence the efficacy of the production of reactions by the nanostructure- or microstructure-substrate combination might vary widely. That is, (a) the fractional coverage or number of nano- or micro-structures per unit area, and (b) the number, shapes and geometrical arrangements of points of contact between the nano- or micro-structures and the substrate might not be susceptible to design and control. Nevertheless, it might still be possible to achieve combinations of nano- or micro-structures and substrates that are effective for inducing desirable reactions, and maybe even controlling reaction rates.

In some cases, partial or full control of the density and geometry of the nano- or micro-structures on the substrate might be achieved. It is possible to use pretreatment of the substrate to control the density and distribution of nano- or micro-structures grown on substrates. That pretreatment includes bombardment of the substrate by any species to induce a controllable number of locations, which will nucleate growth of nano- or micro-structures on the substrate. However, the locations and geometrical arrangement of the nucleation sites would not be controlled by this approach. In a similar fashion, bombardment of the substrate with pre-existing nano- or micro-structures, prior to their separate and later fixation, will lead to an overall density that is controllable, but the precise geometrical arrangement will again remain unspecified.

Full and precise geometrical control of the locations of grown nano- or micro-structures can be achieved on the substrate by use of lithographic methods, although that approach is relatively slow and expensive. Further, lithographic methods can affect the locations, but not necessarily the orientations of the nano- or micro-structures on the substrate.

After growth or fixation of nano- or micro-structures to a substrate, additional processes can be used to achieve the desired structures. In the case of growth from or onto the substrate, partial etching of the nano- or micro-structures by any physical or chemical means might be employed to, for example, produce shared points or edges on the nano- or micro-structures. In the case of fixation of earlier-prepared nano- or micro-structures, excess nano- or micro-structures (those not bonded to the substrate) can be removed by any means, notably vibratory, sonic or ultrasonic agitation. Processes to clean and reconstitute the desired properties of nanostructure- or microstructure-substrate combination after their use, are part of this invention. Without limitation, any dry or wet physical or chemical means, can be used for such cleaning or reconstitution.

Some of the processes for producing nano- or micro-structures on the surfaces of substrates, either by growth or by fixation, involve a sequence of steps. One example is the deposition of a layer on the surface of the substrate, its use to grow nano- or micro-structures on the surface and its later removal. One means of such growth is diffusion controlled by the time(s) that one temperature or a series of temperatures are applied to the substrate to grow nano- or micro-structures. Another example is first putting pre-existing nano- or micro-structures onto the substrate and then joining them by some physical means (such as sintering) or chemical means (such as inducing a reaction between the nano- or micro-structures and the substrate). Any energy source for sintering or to induce chemical reactions can be employed, such as using microwaves or induction for heating and sintering. The type of energy source and its specification for melding prepared nano- or micro-structures to a substrate surface are unconstrained. For example, in the case of using microwaves, frequencies in the range from below 0.9 to over 90 GHz, which any intensity, geometrical distribution or polarization, are acceptable. For induction, frequencies ranging from 1 kHz to 10 MHz (though could be below 1 kHz or above 10 MHz) are acceptable.

Figure 7:
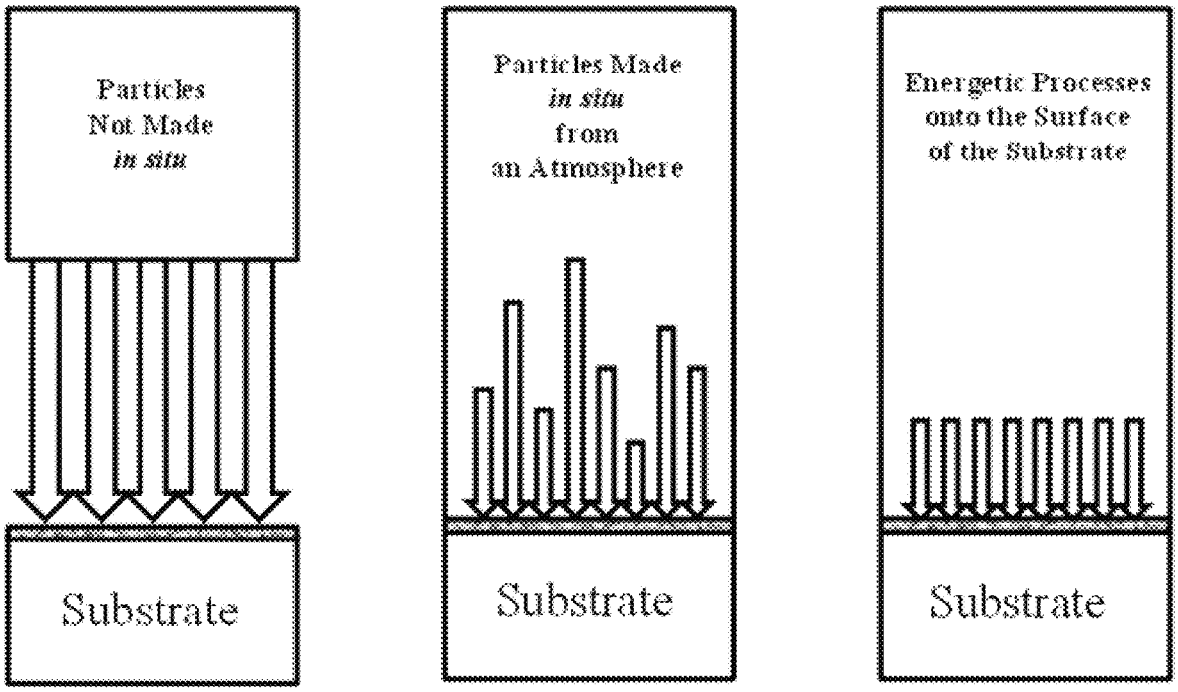
FIG. 7 illustrates three ways to apply particles to a substrate as a coating.

In summary, FIG. 7 illustrates three of the ways in which particles can be applied to the surface of a substrate to make a coating on the substrate. In the first, particles from any exterior source are applied to the substrate. As noted above, a wide variety of particle compositions, shapes and sized and be acquired and applied to various substrates. In the second, particles produced in an atmosphere above the substrate.

The second part of FIG. 7 is the case where the particles are produced from the atoms in the atmosphere in a chamber containing the substrate, and generated by any physical or chemical means. They may form in the atmosphere and then fall onto the substrate, which might be biased electrically to attract them. Similarly, particles might grow on the surface of the substrate by using atoms from the atmosphere. Processes for growing particles on substrates include atmospheres of any composition ranging from ultrahigh vacuum [<10 exp (−9) torr] to thousands of bars [>2000 atmospheres] of any gaseous material. They include temperatures ranging from cryogenic [<100 K] to and beyond the melting points of any involved materials. The ambient atmosphere may contain plasmas with temperatures ranging up to and beyond 10,000 K. Cooling of the substrate during growth on substrates or fixation of the particles to the substrate surface is also contemplated by this invention. Electric or magnetic fields of any character (frequency, strength and orientation) can be applied to the substrate and the ambient atmosphere during growth of particles to influence their geometry, size and orientation, without or with catalysts. Particles can also be grown on substrates using atoms from liquids in contact with the substrate surface, or solids packed onto or near the substrate surface. The composition and other characteristics of the liquids or solids that supply atoms to the particles, such as particle size in the case of solids, and the layer thickness on the substrates for both liquid and solids, are not restricted in any manner.

The third process shown in FIG. 7 involves producing a chemical or plasma atmosphere above the substrate to cause erosion of the substrate, which occurs such that fine-scale structures of substrate material result. Particles produced on the surface of substrates by the second and third illustrated means can be removed for use to make bulk materials or coatings of other substrates. In either particle formation case, they might be later affixed to the substrate surface, if bonding does not occur during the process of particle production. Microwave or inductive energy will be used. In this third approach, energetic processes near the substrate surface modify it to form particles on the surface with compositions originating from and close to that of the substrate. If the particles are made of materials from the substrate, they can be formed by any manner of growth on the substrate, or by removal of material from the substrate to form particles within or on the surface of the substrate. Photons, electrons, ions or plasmas can cause the surface modification. The processes to produce particles from the material of the substrate can be carried out in the absence or presence of electric or magnetic fields of any geometry, frequency or strength, generated by any means, without or with catalysts. Energy for such surface modification processes will originate from microwave or inductive sources.

Regardless of whether the materials constituting the small particles come from the substrate or from any other source of atoms or molecules, the production of the particles can be accelerated or enabled by the employment of catalysts. There are no restrictions on the number or type of catalyst that might be used, or on its method of employment. The catalyst might contain any material(s) with any geometrical shape and size. The catalyst might (a) be produced in place on the substrate by any means, (b) originate from any source and be added to the substrate or nanostructures or (c) involve both of these approaches, either prior to or during any of the processing steps. The catalyst might be left in place after processing or else removed by any means. Removal of the catalyst(s) by any means is the preferred embodiment.

However, the nanometer or micrometer scale particles are obtained or produced, and gotten onto the surface of a substrate, this invention includes the possibility of their modification by any means prior to, during or after placement on the surfaces.

The times for production, modification and fixation of nano- or micro-scale particles are unconstrained in this invention. They can range from less than one minute, in some cases, to over one hour, in extreme cases. The ability for such rapid processing of powders is one of the key features of this invention.

Control of Porosity 116

Referring back to FIG. 2, the invention can be utilized to control the porosity 116 of the desired material. One major aspect of the current invention is to produce structures of any external shape and size, the interiors of which contain materials with grains on the size scale of nanometers or micrometers, which can also contain pore fractions that vary widely. A void is pore that is typically the result of poor manufacturing of material and generally deemed undesirable. The pores can be generated two ways. The first is by using powders of diverse shapes, sizes and compositions without binders, and applying either no or else variable pressures during the preparation stage, and by varying the time and temperature or the microwave or inductive heating. Large pores and pore fractions can be produced by using particles that are large in one or more dimensions, made of strong (hard) materials or either no or else relatively low compaction pressures. Conversely, fine particles, soft materials and high pressures will result in relatively small pores and pore fractions.

Figure 8:
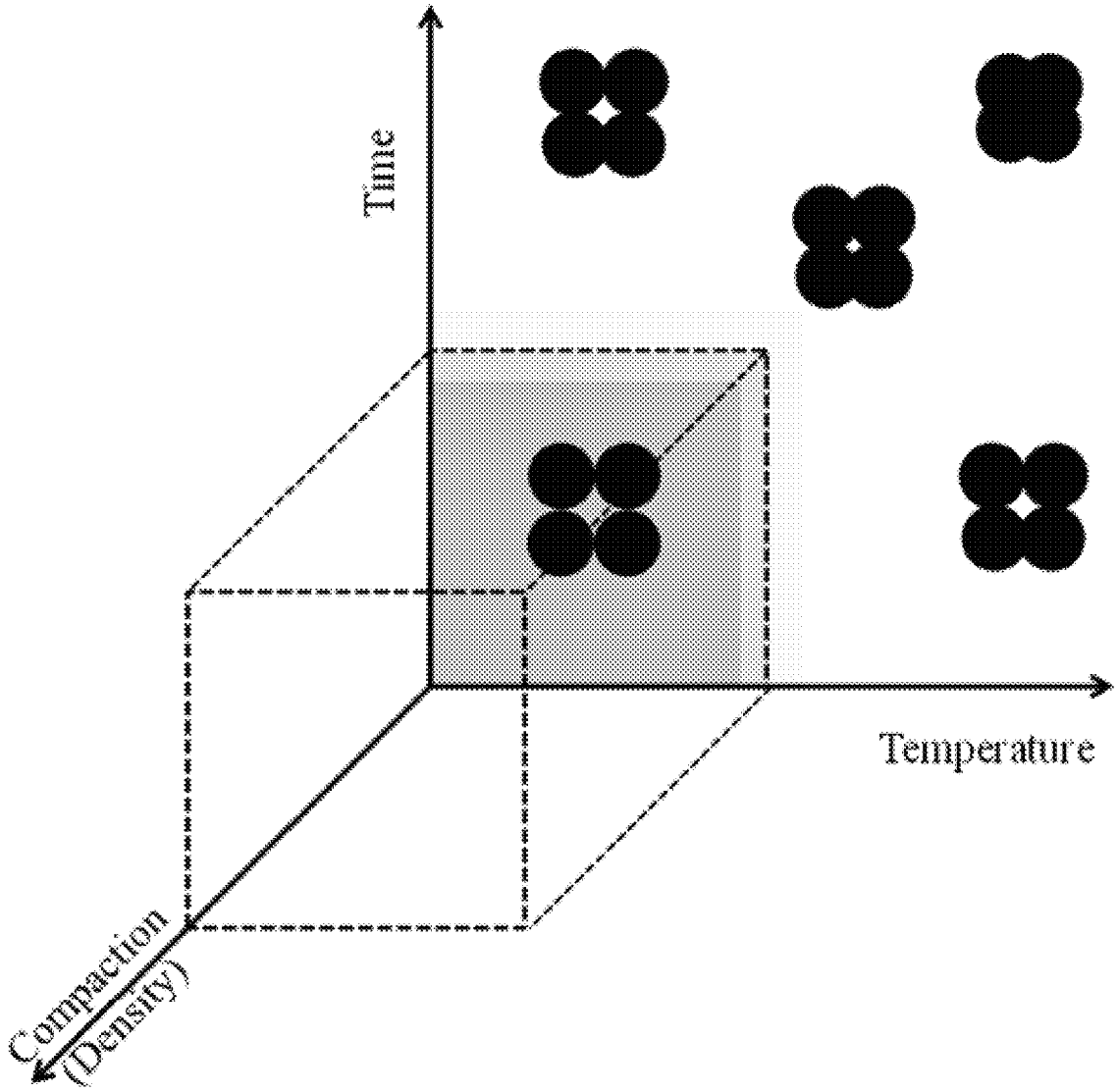
FIG. 8 illustrates the variables to control the porosity of a material.

For any powder or mixture of powders, there are three primary control parameters to vary the porosity of the final material, compaction and the combination of sintering temperature and time. These variables are indicated schematically in FIG. 8. The powders, the way they were molded and the compaction determines the density before sintering. Then, the temperature and time of sintering determines the structure of the bulk or material that results. The diagram in FIG. 8 is meant to emphasize the key fact that relatively low temperatures and short times will be used for materials made by this invention. They will be sufficient to produce macroscopic pieces of materials without degrading the functionality of the nanometer and micrometer particles in the material or coating.

Another means of producing voids in the final structure is by the use of an organic binder, which is removed by heating (pyrolysis) after compaction. This is preferentially done as part of the microwave or inductive processing sequence, although it can be done before or after microwave or inductive heating. Pyrolysis of materials with relatively high melting points leads to removal of most of the binder materials.

Post Processing of Porous Materials 118

The porous bulk or coating materials of chosen density, which are produced by use of this invention, can be used as they are made by any sequence of processing steps. That is, if such materials have properties that are desired for some application, they need not be processed further before use. However, in some cases, it will be desirable or necessary to further process the bulk materials or coatings after they are compacted and sintered. Hence, our process sequence permits the further processing of the bulk materials or coatings after sintering.

The post-processing step(s) can include the use or addition of either or both matter and energy to the as-produced materials or coatings. Sometimes, it will be desirable to add matter to the interior or exterior surfaces of the porous materials. Processes to add material to surfaces can include chemical or physical vapor deposition techniques, among others. In some cases, there is no need to add elements or compounds to the sintered materials. However, application of some energy will produce beneficial changes in the material properties. Heat treatments and irradiation with electromagnetic or particle radiation are other possibilities. Combination of methods for post-processing are also envisioned, either in serial order or by simultaneous means.

Regeneration of Active Materials

Many catalysts consist of particles attached to some substrate material. If the catalysts become fouled or are removed from the substrate during use, it is necessary to replace them with fresh catalysts. It is not possible to reactivate such catalysts in place. The bulk materials with sub-structures on the nanometer and micrometer scale, which result from the disclosed process sequence, permit regeneration of catalysts in place within various reactors. It is only necessary to remove some of the surface of the material in order to expose fresh catalytic surfaces. This can be done by flushing the used catalysts with liquids or gases that will remove any deactivating materials. It can also be accomplished by the production of low temperature plasmas over the porous catalyst surface to remove undesired material by sputtering or reactions to produce gaseous products. Low pressure and temperature glow discharge plasmas are examples of what might be used for regeneration of the catalytic power of bulk or coating materials made with this invention.

Process Flexibility and Variations

FIG. 1 shows that a few hundred options for producing materials of variable porosity with fine-scale sub-structures are possible by use of this invention. This great flexibility is a major strength of the invention. It is important that almost any of the numerous process sequences can be carried out using powders of materials from the major groups, including metals and alloys, elemental and compound semiconductors, ceramics, glasses and other compounds, and polymers and organic materials. This means that many thousands of specific materials can be employed for practice of this invention. Beyond that, the shapes and sizes of particles of any specific starting material are also widely variable. As a result of all these options, this invention is able to produce materials with many millions of variations in compositions, structures, properties and uses.

Anticipated Applications

The properties of most interest of the bulk materials and coatings produced by using this invention influence or determine the ability to induce reactions on or near surfaces involving nuclear, ionic, atomic, molecular and other entities. It is noted that this invention may have significant utility for the catalysis of ordinary chemical reactions. The nano- or micro-meter structures considered herein will also influence, or even determine, properties of structures not having to do with reactions. Possibilities include the scattering of photons, electrons, ions, atoms, molecules and other quanta, among many others. The applications also extend to controlling or otherwise influencing the transport of gases or liquids through permeable (under dense) materials prepared by the processes of this invention.

Illustrative applications of the materials or coatings produced by this invention are widely variable, including but not limited to catalysts; electrodes in batteries, fuel cells, and electrochemical cells; other energy-production devices; and light alloys of elements with widely different melting temperatures, among other existing but unnamed applications, and uses that can be developed by using the methods disclosed by this invention.

The following are illustrative embodiments of the invention. In one embodiment, the invention comprises a multi-step process sequence for production of materials and coatings of variable and controllable density (porosity) with nanometer and micrometer sub-structures having the following illustrative, but not limiting options.

Starting Materials

The use of powders with particles of any composition, shape and size with one or more dimensions in the nanometer (less than 0.1 to over 100 nanometers) or micrometer (less than 0.1 to over 100 micrometers) size ranges, procured, produced and modified by any means prior to their use to produce variable density materials The use of particles in which 3, 2 or 1 of the spatial dimension are on the above scales of nano- or micro-meters. Examples include bucky balls (approximately 0D), carbon nanotubes (approximately 1D) and single or multiple layers of graphene and transition metal dichalcogenides (approximately 2D)

The use of particles made up of metals or alloys, elemental or compound semiconductors, ceramics and other compounds, organic materials and polymers and any other composition.

The use of particles with specific compositions and properties that will lead to the production of the final materials or coatings with desirable properties.

The use of powders with particles made of transition metals and their alloys, which have any shapes and sizes, of any composition and properties, such as hardness.

The use of powders with particles made of metals and alloys that can adsorb and absorb substantial fractions (>0.1 atomic percent) hydrogen isotopes.

The use of ceramic or glass fibers to produce complex networks (arrangements) that can be used without or with other particles in order to produce variable-density materials or coatings.

The use of ceramic or glass particles as dispersoids in order to impede dislocation motion and strengthen the final variable density materials and coatings.

The use of particles of organic materials (generally plastics) and other materials which will cause binding of the particles from the powders in order to reduce or even eliminate requirements for compaction including final materials or coatings with widely variable densities.

The use of powders consisting of particles that have widely different particle sizes, so that the larger particles determine the larger scale sub-structure of the produced materials and the smaller particles fill in the interstitial openings produced by contact of the larger powder grains.

The use of powders with two or more particle shapes and sizes made of metals and alloys that can be used to make layered structures from one of the particle shapes and sizes to another one or more of the particle shapes and sizes, or from small-to-large particle size or large-to-small particle size.

The use of powders in which the particles have shapes that are substantially equiaxed, ranging from spheres and other regular shapes to highly irregular shapes.

The use of powders in which the particles have shapes with high aspect ratios, including carbon and other nanotubes, and nano-materials.

The use of powders consisting of particles that have widely different particle sizes, so that the larger particles determine the larger scale sub-structure of the produced materials and the smaller particles fill in the interstitial openings produced by contact of the larger powder grains.

The use of single or multiple particles with bi-modal, tri-modal or other distributions in any of their characteristics, notably particle size.

The use of mixtures of powders that have widely varying melting points, which will exploit the ability of microwaves or induction to produce rapid heating with little loss of lower melting point materials due to vaporization.

A bonding agent can be used to promote agglomeration of the grains of the powders.

Powder Source

The use of powders which have been purchased or otherwise procured, or else made with or without the use of the processes described below, without or with any processing between obtaining or making the powders and using them for this invention.

The use of chemical, gaseous or plasma means to produce particles with nanometer or micrometer sizes for subsequent use to make variable materials with variable porosity or later fixation to any substrate.

The growth of nanometer or micrometer sizes directly onto the surfaces of any substrate either by bringing such particles to the surface of the substrate or otherwise modifying that surface.

The use of microwaves or other energetic sources to excite or ionize atoms and molecules in a gaseous atmosphere surrounding a work piece of any type, composition and shape for the purpose of beneficially modifying its surface in any manner, especially to produce surface features with nanometer- or micrometer size scales.

Powder Weighing

The use of balances or scales for the weighing of all of the powders that will be incorporated into a bulk material or coating, which have sensitivities of less than one part in 10,000 of the maximum load of any powder.

Weighing of the powders should be done within an inert atmosphere for two reasons, maintenance of the purity of the powders and safety of personnel from exposure to some powders that pose health hazards.

Powder Mixing

The use of mixtures of powders with any number of components in any relative proportions by weight or volume in which the component powders have any composition, shape and size with one or more dimensions in the nanometer or micrometer size range, produced and modified by any means. Furthermore, the component powders are mixed homogeneously, or have alternatively have gradients of any scale in composition, shape, size or concentration of any type in any direction.

The use of mixtures of powders with particle sizes that will produce compacts and microwave- or induction-processed materials that have variable low density with openings throughout the bulk of the produced material, which can serve as conduits for fluids.

The use of mixtures of powders in which one component is an organic material, such as a plastic, which can which can serve as a binder between the particles of other powders in order to produce a stable shape for microwave processing without prior compaction, and remain in the final material, or else be decomposed and expelled from the final material by heating, in order to produce variable density structures.

The use of mixtures of any of the particulate materials with the compositions and structures already listed.

Mixing of the powders should be done within an inert atmosphere for two reasons, maintenance of the purity of the powders and safety of personnel from exposure to some powders that pose health hazards.

Powder Molding

Emplacement of powders or mixtures of powders into molds or containers made of any materials with any shapes, without or with shock, vibration or insonification.

The placement of the powder or powder mixtures into the molds or containers can be done such that the entire contents is homogeneous, or else done in a fashion that will produce layers of any character containing powders with different compositions or structures of any number in any sequence.

The use of open or sealed molds or containers, depending on how any subsequent compaction of the powders will be performed.

Compaction

The production of compacts of powders in the molds by any means, including use of uni-axial high pressure, cold isostatic pressing, or hot isostatic pressing, either with a uniform distribution or gradients in the composition or structure of the constituent particles.

Sintering with Microwaves

The use of microwaves from any radiative source in the frequency range from below 100 MHz to over 1 THz at any generated power level to produce bulk materials.

The use of a system that couples the microwave generator to the material processing chamber with any means to control the transmitted power and the nature of the electromagnetic fields within the sintering chamber.

The use of any type of materials processing chamber capable of holding the molded and compacted workpiece or susceptor in any orientation and accepting microwave radiation of any polarization from below 10 W to above 1 kW and any duration from one second to one hour, with any atmosphere from 10-10 torr vacuum to 100 atmospheres of gases of any composition and relative proportions, with or without means to improve microwave coupling into materials, for example, with a susceptor or microwave-produced plasma in a chamber with variable atmosphere composition and pressure.

The use of heat treating with microwaves or other means to cause pyrolysis of organic materials in the porous materials or coatings.

Sintering with Induction

The use of induction heating from any electrical power source in the frequency range from 1 kHz to 10 MHz (though could be below 1 kHz or over 10 MHz) at any power level for production of material coatings.

The use of a system that couples the source of alternating magnetic fields to the material processing chamber with any means to control the power coupled to a work piece or susceptor during sintering.

The use of any type of materials processing chamber capable of holding the molded and compacted workpiece or susceptor in any orientation and accepting inductive power from below 10 W to above 1 kW and any duration from one second to one hour, with any atmosphere from 10-10 torr vacuum to 100 atmospheres of gases of any composition and relative proportions, with or without means to improve inductive coupling into materials, for example, with a susceptor (or microwave-produced plasma in a chamber with variable atmosphere composition and pressure).

Temperatures and Times

The use of variable temperatures, times and power vs. time curves for microwave or inductive heating of bulk materials with nanometer or micrometer sized particles. The temperatures will range from 100 C to 2000 C, (preferably <0.75 (or <0.5) of the lowest melting point of any of the constituents of the powder mixture) and the times will range from less than one minute to over one hour in rare cases.

The specific sintering temperatures and times to be used will be chosen to insure inter-particle bonding by diffusion, without substantial growth in the size of the particles or densification of the overall material, so that temperatures, times and temperature-time histories to be used will depend on the specific powder compositions and structures that make up the material or coating being processed.

Variable Porosity

The desired variable porosity of the finished bulk materials or coatings will be controlled by use of the following parameters: the compositions, shapes and sizes of the particles used, the mixtures and relative proportions of the different particles, the type and degree of compaction, the temperature, time and temperature-time history during sintering by any means, and the use of sacrificial binder materials that are removed by pyrolysis.

Post Processing

Post-processing of bulk materials with variable porosity by thermal, chemical, mechanical or other means can be employed to modify the composition or structure of the bulk material, with one possibility being chemical vapor deposition from gases flowed through the porous material.

The use any post-coating treatment, including but not limited to any thermal treatment, or physical or chemical vapor deposition from atmospheres of any composition and pressure, which are induced by microwave, inductive or any other means, or any process from a liquid, such as electrodeposition and anodization.

In another embodiment, the invention includes bulk materials with controllable (a) variable densities, (b) spatial distributions of compositions and densities, (c) shape and size of particulate sub-structure, and (d) overall exterior shape and size, produced with the following considerations:

The controllable and variable densities, including relatively low densities with openings throughout the bulk of the produced material, which can serve as conduits for fluids, will be achieved by choices of the following: the compositions, shapes and sizes of the particles used, the mixtures and relative proportions of the different particles, the type and degree of compaction, the temperature and time of sintering by any means, and the use of sacrificial binder materials that are removed by pyrolysis.

The controllable spatial distributions of compositions and densities will be obtained by the following choices: the compositions, shapes and sizes of the particles used, the mixtures and relative proportions of the different particles, the manner of filling the mold by sequential layering or other options, whether the component powders are mixed homogeneously, or have alternatively have gradients of any scale in composition, shape, size or concentration of any type in any direction, the type and degree of compaction, the temperature and time of sintering by any means, and the use of sacrificial binder materials that are removed by pyrolysis.

The controllable shape and size of the particulate substructure on the nanometer or micrometer size scales will be obtained by the following choices: the compositions, shapes and sizes of the particles used, the mixtures and relative proportions of the different particles, the type and degree of compaction, and the temperature and time of sintering by any means, and the shape and size of the particles of sacrificial binder materials that is removed by pyrolysis.

The controllable overall exterior shape and size of the bulk material will depend on the on the size and shape of the mold into which the powders are placed prior to any compaction, and the needed sintering by any means.

In another embodiment, the invention includes coatings for diverse substrate materials which have controllable (a) variable densities, (b) spatial distributions of compositions and densities, (c) shape and size of particulate sub-structure, and (d) overall thickness, produced with the following considerations:

The use of substrates to be coated of any type regardless of the means by which they were produced, cleaned or otherwise modified, regardless of their composition, structure and origin.

The controllable and variable densities, spatial distributions, and shape and size of the particulate sub-structure on the nanometer or micrometer size scales will be achieved by choices of the following: the compositions, shapes and sizes of the particles used, the mixtures and relative proportions of the different particles, the type and degree of compaction, the manner of making contact between particles and substrate, the way in which particles are grown on substrates, any means of modifying the substrates to produce particulate coatings, the temperature and time of sintering by any means, and the use of sacrificial binder materials that may or may not be removed by pyrolysis.

The controllable thickness of the coating material will depend on the size and shape of the mold into which the powders are placed prior to any compaction, and the needed sintering by any means.

The use of procedures, which bring the nanostructures into contact with the substrate, by gravity, application of static electric or magnetic fields of any configuration, orientation and strength, or application of tapping or vibratory, sonic or ultrasonic fields of any geometry, direction, frequency or amplitude. Simple packing of the nanostructures onto the substrate in any configuration inside of an exterior container of any materials, geometry and size to contain the nanostructures is one embodiment.

The ambient atmospheres for bringing together pre-made nanostructures or microstructures and a substrate can vary widely, from high vacuum to gases of any kinds at any temperatures and pressures to liquids in which the nanostructures are suspended. In the last case, the nano particles or micro particles can be left to settle on the substrate under the influence of gravity and diffusive forces. Removal of the liquid carrier for the nanostructures by any means is possible, ranging from decantation to evaporation to freezing followed by sublimation to critical point drying. Application of heat, either from an external source or from within the substrate to remove the liquid, is one of the envisioned processes.

Included processes can provide a bond between the nano- or micro-structures and substrate without any intervening layer by partial melting of the nano- or micro-structures, by partial melting of the substrate or by diffusion of atoms from either or both the nanostructures or substrates onto and into each other to provide a bond by sintering.

Processes are included to provide a bond between the nano- or micro structures and substrate by use of an intermediate layer that serves as an adhesive to meld the nanostructures and the substrate, which layer is of any material and thickness and applied to (coating fully or partially) the substrate prior to application of the nanostructures before the electromagnetic or inductive heating to provide fixation of the nanostructures to the substrate. The bonds between the adhesive layer and the nanostructures, and the adhesive layer and the substrate, can be due to physical adsorption, chemical absorption or diffusional mixing.

The orientations and placements of the nano- or microstructures on substrates can vary widely. In this case of clusters or particles that are equiaxed, the nanostructures reside on the substrate surface in any orientation. Their maximum height above the substrate surface would be similar to their maximum dimension in any of the three dimensions.

The particles with structures having dimensions on the nanometer- or micrometer-scale in only two dimensions can protrude at any angle from the substrate surface, like nanowires or nano-whiskers. In that case, the thickness of the layer of superficial nanostructures might exceed one millimeter. Or, the long dimension might be parallel to the substrate surface for part or all of its length. If the nanostructure contacts the surface over all of its length, its maximum height above the substrate would be similar to the lateral (cross sectional) dimension of the structure.

Particles with nano- or micro-structures that have dimensions on the finest-scale in only one dimension can be affixed to the substrate in any manner ranging from a very few isolated points of contact, to lines of contact of any width and arrangement to contact over all of the surface of the thin film for the case of flat films lying flat on the substrate. Any orientation of the flat and small nanostructures on the substrate is permitted.

The superficial nano- or micro-structures need not only contact the substrate. They can also be in contact with each other, although it is their adherence to the substrate that is the focus of this invention. That is, contact between nano- or micro-structures above the substrate may provide beneficial effects on the ability of the substrate-nanostructure or substrate-microstructure combinations to induce or promote reactions or influence other properties, such as permeability.

The placement of nano- or micro-structures on the substrates, and hence their areal densities, can be either uncontrolled or controlled in some fashion. The areal density can be defined in at least two different ways. One is the fraction of the substrate surface area that is in contact with nano- or micro-structures of any shape or orientation. This fraction can vary widely from very a small value, say for linear nano- or micro-structures that contact the substrate only at their ends, to unity for contacts everywhere in the case of thin particles that are larger in two dimensions.

Another measure of areal density is the fraction of the substrate surface area that is covered by nano- or microstructures, whatever their shape, size or orientation. Here again, the fraction can be very small, say for widely-dispersed small particles, to over unity, such as overlapping thin films oriented more or less parallel to the substrate surface. Both fractions can also be expressed as cm2 for the contact or coverage per cm2 of the substrate. It is also possible to use the mass of nano- or micro-structures per cm2 of the substrate as the measure of goodness of the processes disclosed here.

Growth of nano- or micro-structures on substrates or addition of pre-existing nano- or micro-structures to a substrate can be unconstrained, that is, uncontrolled. In this case, two variables that can influence the efficacy of the production of reactions by the nanostructure- or microstructure-substrate combination might vary widely. That is, (a) the fractional coverage or number of nano- or micro-structures per unit area, and (b) the number, shapes and geometrical arrangements of points of contact between the nano- or micro-structures and the substrate might not be susceptible to design and control.

Processes for growing particles on substrates include atmospheres of any composition ranging from ultrahigh vacuum [<10 exp (−9) torr] to thousands of bars [>2000 atmospheres] of any gaseous material. They include temperatures ranging from cryogenic [<100 K] to and beyond the melting points of any involved materials. The ambient atmosphere may contain plasmas with temperatures ranging up to and beyond 10,000 K In some cases, partial or full control of the density and geometry of the nano- or micro-structures on the substrate might be achieved. It is possible to use pretreatment of the substrate to control the density and distribution of nano- or micro-structures grown on substrates. That pretreatment includes bombardment of the substrate by any species to induce a controllable number of locations, which will nucleate growth of nano- or micro-structures on the substrate. However, the locations and geometrical arrangement of the nucleation sites would not be controlled by this approach. In a similar fashion, bombardment of the substrate with pre-existing nano- or micro-structures, prior to their separate and later fixation, will lead to an overall density that is controllable, but the precise geometrical arrangement will again remain unspecified.

Full and precise geometrical control of the locations of grown nano- or micro-structures can be achieved on the substrate by use of lithographic methods, although that approach is relatively slow and expensive. Further, lithographic methods can affect the locations, but not necessarily the orientations of the nano- or micro-structures on the substrate.

After growth or fixation of nano- or micro-structures to a substrate, additional processes can be used to achieve the desired structures. In the case of growth from or onto the substrate, partial etching of the nano- or micro-structures by any physical or chemical means might be employed to, for example, produce shared points or edges on the nano- or micro-structures. In the case of fixation of earlier-prepared nano- or micro-structures, excess nano- or micro-structures (those not bonded to the substrate) can be removed by any means, notably vibratory, sonic or ultrasonic agitation. Processes to clean and reconstitute the desired properties of nanostructure- or microstructure-substrate combination after their use, are part of this invention. Without limitation, any dry or wet physical or chemical means, can be used for such cleaning or reconstitution.

Some of the processes for producing nano- or micro-structures on the surfaces of substrates, either by growth or by fixation, involve a sequence of steps. One example is the deposition of a layer on the surface of the substrate, its use to grow nano- or micro-structures on the surface and its later removal. One means of such growth is diffusion controlled by the time(s) that one temperature or a series of temperatures are applied to the substrate to grow nano- or micro-structures. Another example is first putting pre-existing nano- or micro-structures onto the substrate and then joining them by some physical means (such as sintering) or chemical means (such as inducing a reaction between the nano- or micro-structures and the substrate).

Any energy source for sintering or to induce chemical reactions can be employed, such as using microwaves or induction for heating and sintering. The type of energy source and its specification for melding prepared nano- or micro-structures to a substrate surface are unconstrained.

In yet another embodiment, the invention comprises systems and methods to reactivate catalytic materials consisting of bulk materials or coatings with controllable (a) variable densities, (b) spatial distributions of compositions and densities, (c) shape and size of particulate sub-structure, and (d) overall thickness, follow:

Since a major use of the bulk materials and coatings, which are the subject of this invention, will be for catalysis of diverse reactions, and catalysts become fouled or otherwise deactivated during use, methods to reactivate the materials or coatings by liquid, gaseous or plasma processes are claimed. They include but are not limited to chemical etching by any means, and physical processes such as sputtering.

The fact that the bulk materials and coatings produced by the disclosed methods will be much thicker than the partial or thin layers of current catalysts on their substrates means that the materials and coatings of this invention can be reactivated many times without losing their efficacy, even though some catalytic material will be removed, along with the materials causing inactivation, during each reactivation.

Examples

It is noted that the production of materials of any type by any process is iterative. Materials are made under some conditions, for example some compositions, dimensions, compaction, temperature and time. Then they are tested to see if they have the desired properties. If they do not have the desired properties, then other processing conditions (or related compositions) are tried. Illustrative examples of the use and results of employment of the system and method of this invention follow:

1. The material to be produced has a rectangular solid form in which the constituent particles are bonded together to form a unit without loss of their desirable properties due to their small sizes with thickness of 1-500 mm, and preferably from 1 to 10 mm, and widths and lengths of 10 to 100 mm, and preferably from 1-100 mm, which has a sub-structure of particles sintered into one unit (i.e., that the particles are adhered together, whereby a loose or friable compacted powder is now a single piece of material due to diffusion between particles during the time of sintering). A solid material does not deform easily under mechanical stress (as a liquid or paste) and can be handled as a unit for insertion into reactors, when it is used as a catalyst, for example, or machined for use as small lightweight parts for any purpose. The particles in the starting mixture of powders have sizes on the scales of nanometers or micrometers, and compositions and other features that make them catalytically active for any chemical or nuclear process.

The starting powders would contain transition metals, such as iron, nickel, or palladium, which are commonly used as catalyst, be compacted to 80% of full density, and processed at temperatures in the range of 0.25 to 0.95 of the melting point of the starting material, and more generally from 0.25-0.95 of the melting point, with the lowest melting point for times of 1 to 10 minutes, and more generally from 0.1-30 minutes, again depending on the constituent materials.

The produced materials would be used as a catalyst for production of chemicals, generally, and for the productions of drugs and processing of petrochemicals, more specifically. The material would be thick enough to enable cleaning of the surface after use by any liquid, gaseous or plasma method to restore the initial catalytic properties of the material. The desired final property is chemical activity, which is determined by composition and structure of the material at all levels. Porosity is an important variable influencing or enabling catalytic activity.

2. The material to be produced would have the same overall shape as in 1 above, which would be mixed and molded, and not be compacted, but otherwise processed as indicated above, so that gaseous reactants can flow through the material during production of desired chemicals. The produced material would serve as a catalyst for the chemical process.

3. The material to be produced would be a coating on the surface of a cylindrical rod with diameter of 1 to 10 mm, with a thickness in the range of 0.1 to 5 mm, which has a sub-structure of particles sintered into one unit and adherent to the rod, the particles in the starting mixture of powders of transition metals such as iron, nickel or palladium, having sizes on the scales of nanometers or micrometers, and compositions and other features that make them catalytically active for any chemical or nuclear process. The starting powders would contain transition metals, be compacted to 80% of full density, and processed at temperatures in the range of 0.5 to 0.75 (and more generally from 0.25-0.95 or <0.5) of the melting point of the starting material with the lowest melting point for times of 1 to 10 minutes (and more generally from 0.1-30 minutes), again depending on the constituent materials. The produced coating material would be used as a catalyst, and would be thick enough to enable cleaning of the surface after use by any liquid, gaseous or plasma method to restore the initial catalytic properties of the material. Multiple rods could be arranged within a flow processing chamber, much like the tubes in a boiler, to permit high probabilities of interactions of the coatings with flowing liquid or gaseous reactants. They could be cleaned and reinvigorated either in place or removed and restored to an active catalytic state in an ancillary chamber.

4. The material to be produced would be an alloy of two elements with widely different melting points, for example, lithium and magnesium, or magnesium and titanium, with exterior dimensions of at least 10 mm and less than 1 meter in all dimensions (directions). The use of starting powders with particles on the scale of nanometers or micrometers would insure that the material would have in internal structure that would impede dislocation motion when the material is stressed, making it strong. The use of rapid microwave or induction processing would insure that little or none of the low melting point element is lost during production of the material, and also restrict undesirable grain growth to insure a high mechanical strength.

Conclusion

Accordingly, the invention takes into account that the properties and, hence, the applications of materials vary, and commonly improve, as the size of particles of materials is reduced to the micrometer and nanometer size scales. Such materials have to be either handled as loose powders, which is both difficult and a health hazard, or else attached to the surface of some other material (a substrate), so that they will not be lost during use. Such fine-scale materials are commonly used as catalysts for chemical processing, which involves the flow of liquids or gasses over the particles.

In addition, when it is desirable to form alloys of both low and high melting point elements to make light, but strong materials, there can be loss of properties. Alloying lithium with magnesium is an example. The difficulty is that conventional heating will result in loss of the low melting point elements, and result in alloys that do not have the desired composition and properties. Thus, it is desirable to have starting powders with very fine size scales to insure that the resulting alloys have complex internal structures to impede dislocation motion and strengthen the alloys.

The present invention produces larger integral pieces of material while still maintaining the fine-scale structures (i.e., sub-structures) that offer desirable properties. Thus, the larger bulk material physically has small sub-structures, and/or the larger bulk materials retain the desirable properties of the finer particles. That is, the larger (bulk or coating) material has fine scale structures because of starting with fine scale particles and using fast sintering with only enough temperature and time to adhere the particles to each other to form a unit without destroying their small sized by grain (particle) growth. Hence, the larger material does retain the desirable properties of the small grains because it is, to a good approximation, a collection of such particles. But, now, it can be handled and machined. And, being thick, unlike the particles of catalysts affixed to substrates now in use, the bulk or coating materials, which can be made with this invention, can be eroded (cleaned) to remove materials that degrade or kill their catalytic effectiveness. Overall, so, they can offer both cost and operational advantages. These facts are at the heart of this invention. They offer the advantage of being large enough to handle and install into processing systems and other assemblies, while still offering the good properties of fine-scale particles. Further, having such larger pieces, rather than a sparse distribution of particles on some substrate, permits removing some of the surface of the piece of material if it is contaminated, and restoring the properties of the materials, say as a catalyst in a process. The fast heating and sintering maintains desirable particulate properties in the larger produced material or coating on another materials.

In addition, the rapid heating of fine powders using this invention permits the use of powders of any materials (metals and alloys, elemental and compound semiconductors, ceramics and glasses, and organic and plastic materials) to form new bulk or coating materials despite variations in melting and softening points The diversity of starting materials (composition, particle shapes, particle sizes, relative compositions in powder mixtures, spatial arrangements of the particles, etc.), and the diversity of options for each of the many steps in the disclosed method, can result in materials having a diversity of exterior shapes, compositions and substructures, and hence, properties and uses. In addition, the ability to control porosity be using variations in compaction, sintering temperatures and sintering times is doubly desirable. It produces a very wide variety of materials with controllable properties and applications. Also, it requires less of expensive powders due to the porosity.

There are options in many steps of the method of this invention. For example, different types of scales may be used to weight the amounts of the powders to be mixed and further processed. There are options for the formation of molds and for the means of compaction, if that process is used. And, some powder mixtures can be processed by either or both microwave and induction heating. These are only three examples of options.

Using the steps of the method of this invention will result in desired materials or coatings with the compositions and structures that yield desirable properties, and hence various applications. The invention can be used to make catalysts for diverse chemical industries, including the production of bulk chemicals, petrochemicals, drugs, etc. It can also be used to make electrodes for batteries, fuel cells and other energy producing systems. Light, but strong alloys can be made with the method of this invention. Given the flexibility of the system and method of the invention, it is likely that other uses will be found for the materials and coatings produced by using the invention.

The foregoing description and drawings should be considered as illustrative only of the principles of the invention. The invention may be configured in a variety of shapes and sizes and is not intended to be limited by the embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A method for production of a desired material or desired coating, said method comprising a sequence of process steps to produce the desired materials or the desired coatings with variable and controllable porosity, including:

providing a powder material having a sub-structure of particles, the particles having a nanometer or micrometer size, wherein the powder material comprises any of metallic, semiconductor, insulating, ceramic, glass, polymer or organic materials, carbon allotropes, or combinations thereof;

compacting the powder material in the absence of any binder or filler, to a selected density; and rapid heating the compacted powder material at a selected temperature, in the absence of any binder or filler and in the absence of pyrolysis, for no more than about 10 minutes with any variation of temperature as a function of time to bind the powder material and produce the desired material or coating having a desired porosity, wherein the desired porosity is controlled based on the compositions, shapes and sizes of the particles of the powered material, the type and degree of compaction, the selected temperature, and time and temperature-time history during the rapid heating.

2. The method of claim 1, further comprising placing the powder in a mold prior to the step of compacting.

3. The method of claim 1, wherein the selected temperature is 0.25-0.95 of a melting point for the powder material.

4. The method of claim 1, wherein the desired material has a thickness of 1 to 500 mm or the desired coating has a thickness of 0.1-10 mm.

5. The method of claim 1, wherein the desired material or coating has a width and length of 1-100 mm.

6. The method of claim 1, wherein the particles have a size of 0.1-100 nm or 0.1 micrometers to 10 millimeters in width, height, or length, regardless of particle shape.

7. The method of claim 1, wherein the selected density comprises 10% to substantially 100% of full density of the final material.

8. The method of claim 1, wherein said particles have desired properties and their mixture has a desired porosity, wherein said compacting and said heating decrease the porosity of said particle but preserve the desired properties.

9. The method of claim 8, wherein said desired properties are chemical, mechanical, electronic, optical, magnetic, or other properties of utility.

10. The method of claim 1, wherein the desired material comprises macroscopic porous materials with internal structure on the scale of nanometers or micrometers.

11. The method of claim 1, wherein said heating comprises microwave or induction heating with any variation of temperature as a function of time.

12. The method of claim 11, wherein said microwave is in the frequency range of 100 MHz-1 THz.

13. The method of claim 11, wherein said induction heating is in the frequency range of 1 kHz-10 MHz.

14. A method for production of a desired material or desired coating, said method comprising a sequence of process steps to produce the desired materials or the desired coatings with variable and controllable porosity, including:

providing a powder material having a sub-structure of particles, the particles having a nanometer or micrometer size, wherein the powder material comprises any of metallic, semiconductor, insulating, ceramic, glass, polymer or organic materials, carbon allotropes, or combinations thereof;

placing the powder material in a container;

after placing the powder in the container, compacting the powder material to a selected density; and after the step of compacting the powder material, no more than a single heating step of rapid heating the compacted powder material at a selected temperature for no more than about 10 minutes with any variation of temperature as a function of time to produce the desired material or coating having a desired porosity, in the absence of any fillers or binders and in the absence of pyrolysis.

15. The method of claim 14, wherein the rapid heating includes sintering the compacted power material in the container.

16. The method of claim 15, wherein the desired porosity is controlled based on the compositions, shapes and sizes of the particles of the powered material, the type and degree of compaction, the selected temperature, and time and temperature-time history during the rapid heating.

* * * * *